US008765341B2

(12) United States Patent
Korenaga et al.

(10) Patent No.: US 8,765,341 B2
(45) **Date of Patent: *Jul. 1, 2014**

(54) ELECTROPHOTOGRAPHIC PHOTORECEPTOR, PROCESS CARTRIDGE, AND IMAGE FORMING APPARATUS

(75) Inventors: Jiro Korenaga, Kanagawa (JP); Daisuke Haruyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/606,864

(22) Filed: Sep. 7, 2012

(65) Prior Publication Data

US 2013/0252148 A1 Sep. 26, 2013

(30) Foreign Application Priority Data

Mar. 23, 2012 (JP) ..... 2012-068289

(51) Int. Cl.
*G03G 15/04* (2006.01)

(52) U.S. Cl.
USPC ..... 430/66; 430/69

(58) Field of Classification Search
USPC ..... 430/56, 66, 69
See application file for complete search history.

(56) References Cited

U.S. PATENT DOCUMENTS

| | | | | |
|---|---|---|---|---|
| 4,792,507 | A | 12/1988 | Yoshihara et al. | |
| 2001/0031412 | A1* | 10/2001 | Itami et al. | 430/58.15 |
| 2002/0119382 | A1 | 8/2002 | Nakata et al. | |
| 2005/0255393 | A1 | 11/2005 | Nakata et al. | |
| 2006/0019185 | A1* | 1/2006 | Amamiya et al. | 430/66 |
| 2012/0251932 | A1* | 10/2012 | Iwasaki et al. | 430/56 |

FOREIGN PATENT DOCUMENTS

| | | |
|---|---|---|
| JP | A-56-51749 | 5/1981 |
| JP | A-63-221355 | 9/1988 |
| JP | A-5-99737 | 4/1993 |
| JP | A-8-278645 | 10/1996 |
| JP | A-2002-82469 | 3/2002 |
| JP | A-2003-186234 | 7/2003 |
| JP | A-2005-91500 | 4/2005 |
| JP | B2-3938209 | 6/2007 |

* cited by examiner

*Primary Examiner* — Stewart Fraser
(74) *Attorney, Agent, or Firm* — Oliff PLC

(57) ABSTRACT

An electrophotographic photoreceptor includes a conductive substrate, a photosensitive layer that is provided on the conductive substrate, and a surface layer that is provided on the photosensitive layer or is contained in the photosensitive layer, wherein the surface layer is formed of a cured film of a composition including a first reactive charge transport material having a hydroxyl group and a second reactive charge transport material having a methoxy group, and has an elastic deformation ratio R satisfying the following Expression (1):

$0.40 \leq R \leq 0.51$.

17 Claims, 6 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2012-068289 filed Mar. 23, 2012.

BACKGROUND

1. Technical Field

The present invention relates to an electrophotographic photoreceptor, a process cartridge, and an image forming apparatus.

2. Related Art

In recent years, resins having high mechanical strength have been used in electrophotographic photoreceptors, the life span of which has increased.

SUMMARY

According to an aspect of the invention, there is provided an electrophotographic photoreceptor including a conductive substrate, a photosensitive layer that is provided on the conductive substrate, and a surface layer that is provided on the photosensitive layer or is contained in the photosensitive layer, wherein the surface layer is formed of a cured film of a composition including a first reactive charge transport material having a hydroxyl group and a second reactive charge transport material having a methoxy group, and has an elastic deformation ratio R satisfying the following Expression (1):

$$0.40 \leq R \leq 0.51 \quad (1).$$

BRIEF DESCRIPTION OF THE DRAWINGS

Exemplary embodiments of the present invention will be described in detail based on the following figures, wherein.

DETAILED DESCRIPTION

Figure 1:
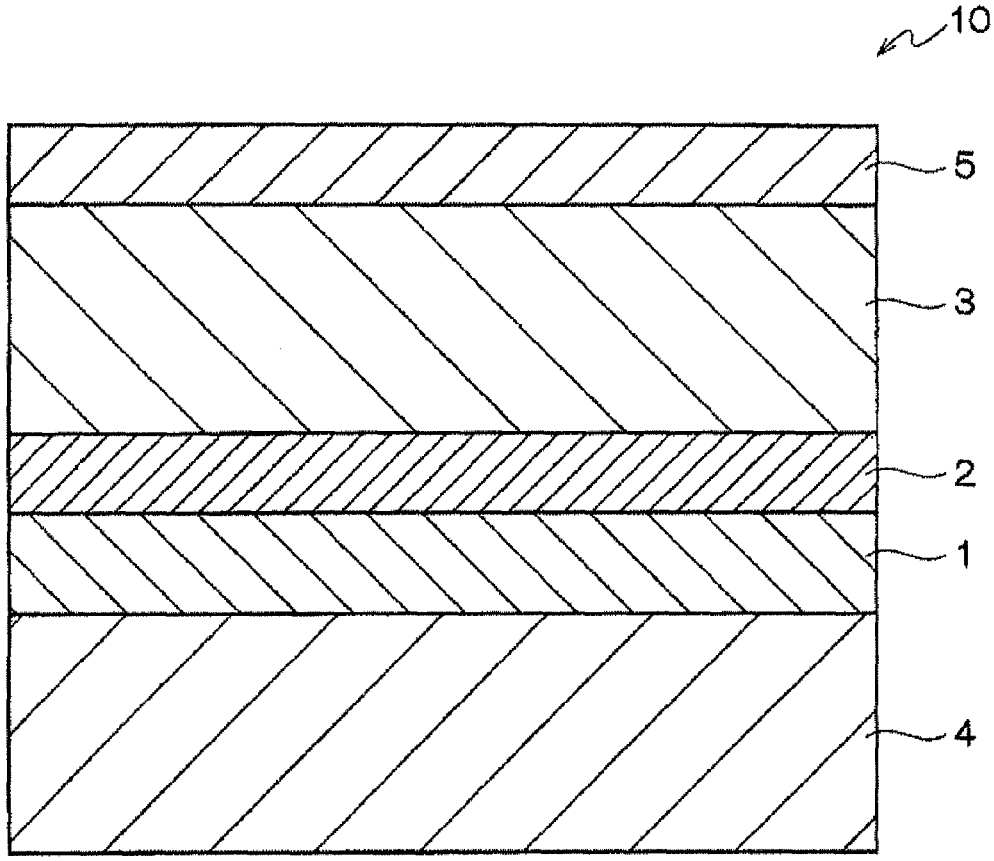
FIG. 1 is a partial cross-sectional view schematically showing an electrophotographic photoreceptor according to an exemplary embodiment.

Hereinafter, exemplary embodiments of the invention will be described.

Electrophotographic Photoreceptor

An electrophotographic photoreceptor according to this exemplary embodiment has a conductive substrate and a photosensitive layer that is provided on the conductive substrate.

The outermost surface layer of the electrophotographic photoreceptor according to this exemplary embodiment is a layer that is formed of a cured film of a composition including at least two types of reactive charge transport materials that are respectively selected from first reactive charge transport materials having a —OH group as a reactive functional group and from second reactive charge transport materials having a —$OCH_3$ group as a reactive functional group, and in which an elastic deformation ratio R satisfies the following Expression (1):

$$0.40 \leq R \leq 0.51.$$

Here, in the case in which images are repeatedly formed, when the abrasion resistance of the outermost surface layer of the electrophotographic photoreceptor is improved, there is a difference between a position having a large developer amount and a position having a small developer amount in the abrasion amount of a cleaning blade that is contacted the electrophotographic photoreceptor to clean it. Whereby, a problem occurs in cleaning of the electrophotographic photoreceptor, and thus unevenness in image density easily occurs.

On the other hand, when the abrasion resistance of the outermost surface layer of the electrophotographic photoreceptor is reduced, there is a difference between a position having a large developer amount and a position having a small developer amount in the abrasion amount of the outermost surface layer of the electrophotographic photoreceptor, and thus a problem occurs in cleaning and unevenness in image density easily occurs.

Accordingly, in the electrophotographic photoreceptor according to this exemplary embodiment, an elastic deformation ratio R of the outermost surface layer is appropriately adjusted so as to satisfy the above Expression (1) in the system of the outermost surface layer formed of the cured film of the composition including the reactive charge transport materials. In addition, in order to appropriately adjust the elastic deformation ratio R of the outermost surface layer to the above range, at least two types of reactive charge transport materials, that is, a first reactive charge transport material having a —OH group as a reactive functional group and a second reactive charge transport material having a —$OCH_3$ group as a reactive functional group are used in combination.

Therefore, even in the case in which images are repeatedly formed, an increase in the difference between a position having a large developer amount (for example, image part) and a position having a small developer amount (for example, non-image part) in the abrasion amount of the cleaning blade is suppressed, and an increase in the difference between a position having a large developer amount (for example, image part) and a position having a small developer amount (for example, non-image part) in the abrasion amount of the outermost surface layer of the electrophotographic photoreceptor is also suppressed.

Regarding this, it is thought that this is because when the reaction rapidly proceeds with the first reactive charge transport material having a —OH group as a reactive functional group with a high reaction rate, an unreacted product is easily generated and the elastic deformation ratio R is thus easily reduced, but the unreacted product is complemented due to the reaction of the second reactive charge transport material having a —$OCH_3$ group as a reactive functional group with a low reaction rate, and the elastic deformation ratio R is thus easily adjusted to the appropriate range.

As a result, in the electrophotographic photoreceptor according to this exemplary embodiment, unevenness in image density due to the cleaning problem generated when repeatedly forming images is suppressed.

In addition, in the case in which the images are repeatedly formed, when there is an increase in a difference between a position having a large developer amount (for example, image part) and a position having a small developer amount (for example, non-image part) in the abrasion amount of the outermost surface layer of the electrophotographic photoreceptor or the cleaning blade, fogging also easily occurs. However, in the electrophotographic photoreceptor according to this exemplary embodiment, the occurrence of the fogging is also easily suppressed.

Hereinafter, the electrophotographic photoreceptor according to this exemplary embodiment will be described in detail with reference to the drawings.

Figure 2:
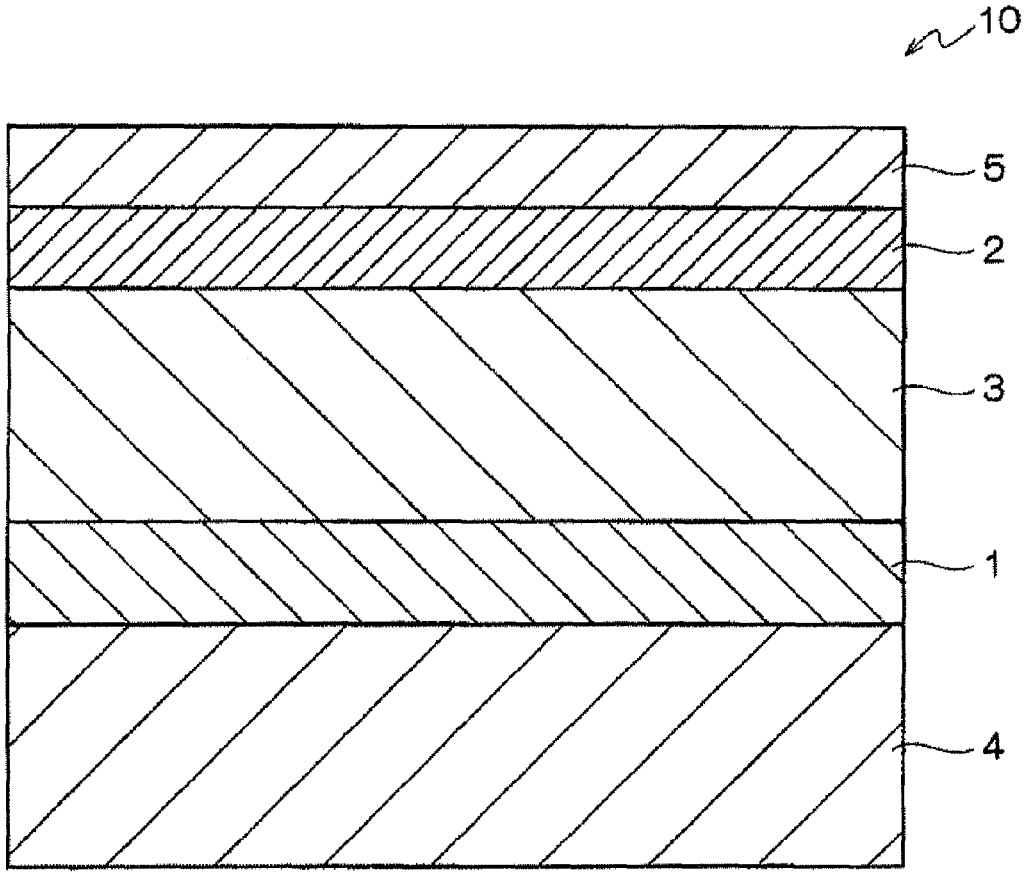
FIG. 2 is a partial cross-sectional view schematically showing an electrophotographic photoreceptor according to another exemplary embodiment.
Figure 3:
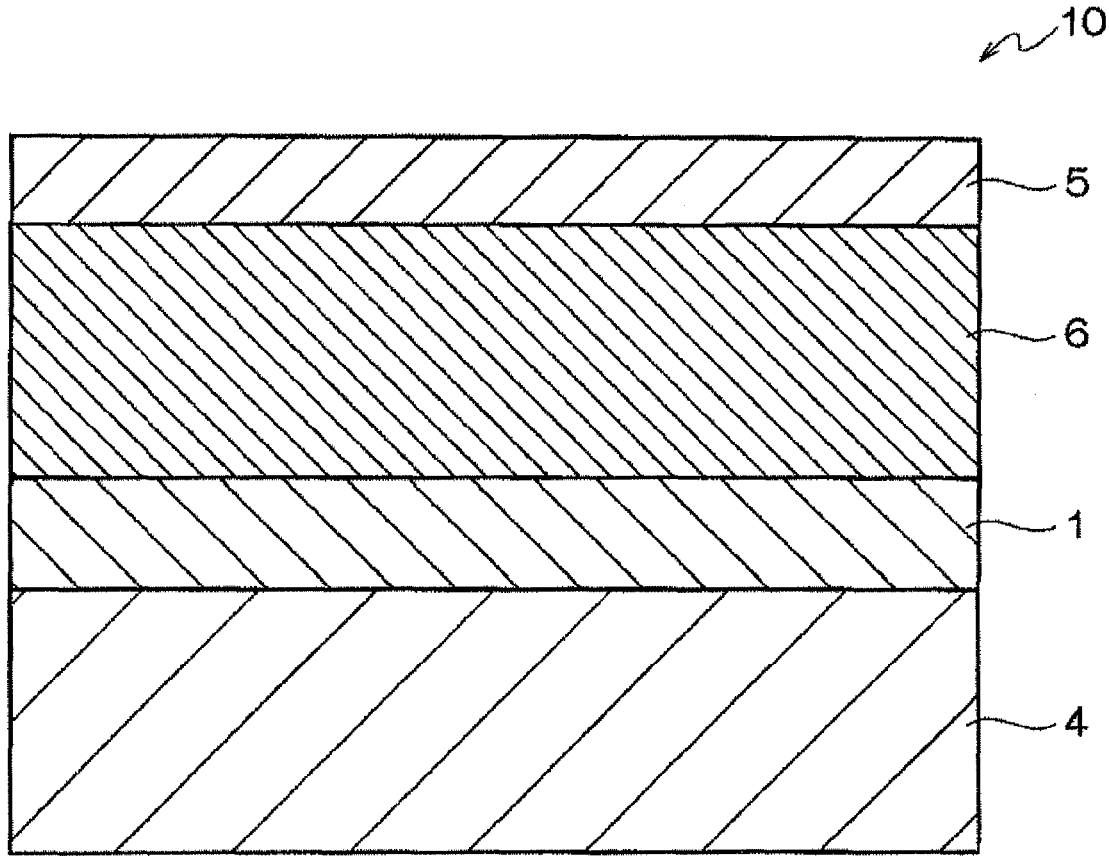
FIG. 3 is a partial cross-sectional view schematically showing an electrophotographic photoreceptor according to yet another exemplary embodiment.

FIGS. 1 to 3 each schematically show the cross-section of a part of an electrophotographic photoreceptor 10 according to this exemplary embodiment.

In the electrophotographic photoreceptor 10 shown in FIG. 1, an undercoat layer 1 is provided on a conductive support 4, a charge generation layer 2 and a charge transport layer 3 as photosensitive layers are provided on the undercoat layer, and a surface protective layer 5 as an outermost surface layer is provided thereon.

In the electrophotographic photoreceptor 10 shown in FIG. 2, although photosensitive layers having separate functions are provided such as a charge generation layer 2 and a charge transport layer 3 as in the electrophotographic photoreceptor 10 shown in FIG. 1, the charge transport layer 3, the charge generation layer 2, and a surface protective layer 5 are provided in that order on an undercoat layer 1.

In the electrophotographic photoreceptor 10 shown in FIG. 3, a charge generation material and a charge transport material are contained in the same layer, that is, a single layer-type photosensitive layer 6 (charge generation/charge transport layer), and a surface protective layer 5 is provided on the photosensitive layer 6.

In the electrophotographic photoreceptors 10 shown in FIGS. 1 to 3, the surface protective layer 5 is provided on the photosensitive layer, and the surface protective layer 5 serves as an outermost surface layer. However, when the surface protective layer 5 is not provided, the uppermost layer of the photosensitive layer serves as an outermost surface layer. Specifically, in the case of a layer configuration that is the same as the layer configuration of the electrophotographic photoreceptor 10 shown in FIG. 1 except that the surface protective layer 5 is not provided, the charge transport layer 3 corresponds to an outermost surface layer. In addition, in the case of a layer configuration that is the same as the layer configuration of the electrophotographic photoreceptor 10 shown in FIG. 3 except that the surface protective layer 5 is not provided, the single layer-type photosensitive layer 6 corresponds to an outermost surface layer.

Hereinafter, the respective elements will be described on the basis of the electrophotographic photoreceptors 10 shown in the drawings as representative examples. The reference numbers will be omitted.

Conductive Substrate

As the conductive substrate, any one may be used if it has been used hitherto. Examples thereof include paper and plastic films coated or impregnated with a conductivity imparting agent, such as plastic films having a thin film (for example, metals such as aluminum, nickel, chromium, and stainless steel, and films of aluminum, titanium, nickel, chromium, stainless steel, gold, vanadium, tin oxide, indium oxide, and indium tin oxide (ITO)) provided thereon. The shape of the substrate is not limited to a cylindrical shape, and may be a sheet shape or a plate shape.

When a metallic pipe is used as the conductive substrate, the surface thereof may be used as it is, or may be subjected to specular machining, etching, anodization, coarse machining, centerless grinding, sand blasting, wet honing, or the like in advance.

Undercoat Layer

The undercoat layer is provided as necessary to prevent light reflection on the surface of the conductive substrate, and to prevent unnecessary carriers from flowing from the conductive substrate to the photosensitive layer.

The undercoat layer includes, for example, a binder resin, and if necessary, other additives.

Examples of the binder resin included in the undercoat layer include known polymeric resin compounds e.g., an acetal resins such as polyvinyl butyral, polyvinyl alcohol resins, casein, polyimide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins; charge-transporting resins having a charge transport group; and conductive resins such as polyaniline. Among them, resins insoluble in the coating solvent of the upper layer are preferably used, and phenol resins, phenol-formaldehyde resins, melamine resins, urethane resins, and epoxy resins, and the like are particularly preferably used.

The undercoat layer may contain a metallic compound such as a silicon compound, an organic zirconium compound, an organic titanium compound, and an organic aluminum compound.

The ratio of the metallic compound to the binder resin is not particularly limited, and may be set so that desired electrophotographic photoreceptor characteristics are obtained.

Resin particles may be added to the undercoat layer in order to adjust surface roughness. Examples of the resin particles include silicone resin particles and cross-linked polymethylmethacrylate (PMMA) resin particles. After forming the undercoat layer, the surface thereof may be polished in order to adjust surface roughness. Examples of the polishing method include buff polishing, sand blasting, wet honing, and grinding.

Here, examples of the configuration of the undercoat layer include a configuration in which at least a binder resin and conductive particles are contained. The conductive particles may have a conductive property in which the volume resistivity is, for example, less than $10^7$ Ω·cm.

Examples of the conductive particles include metallic particles (aluminum particles, copper particles, nickel particles, silver particles, and the like), conductive metallic oxide particles (antimony oxide particles, indium oxide particles, tin oxide particles, zinc oxide particles, and the like), and conductive substance particles (carbon fiber particles, carbon black particles, and graphite powder particles). Among them, conductive metallic oxide particles are preferable. The conductive particles may be used in mixture of two or more types.

In addition, the conductive particles may be used after being surface-treated with a hydrophobizing agent or the like (for example, coupling agent) for adjusting the resistance.

The content of the conductive particles is preferably 10% by weight to 80% by weight, and more preferably 40% by weight to 80% by weight with respect to the binder resin.

In the formation of the undercoat layer, a coating liquid for undercoat layer formation is used in which the above components are added to a solvent.

In addition, as a method of dispersing the particles in the coating liquid for undercoat layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Here, examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

Examples of the method of coating the conductive substrate with the coating liquid for undercoat layer formation include a dipping coating method, an extrusion coating method, a wire bar coating method, a spray coating method, a blade coating method, a knife coating method, and a curtain coating method.

The thickness of the undercoat layer is preferably 15 μm or greater, and more preferably from 20 μm to 50 μm.

Here, although omitted in the drawings, an intermediate layer may be further provided between the undercoat layer and the photosensitive layer. Examples of the binder resins for use in the intermediate layer include polymeric resin compounds e.g., acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins; and organic metallic compounds containing zirconium, titanium, aluminum, manganese, and silicon atoms. These compounds may be used singly or as a mixture or polycondensate of the plural compounds. Among them, an organic metallic compound containing zirconium or silicon is preferable because it has a low residual potential, and thus a change in potential due to the environment is small, and a change in potential due to the repeated use is small.

In the formation of the intermediate layer, a coating liquid for intermediate layer formation is used in which the above components are added to a solvent.

As a coating method for forming the intermediate layer, a general method is used such as a dipping coating method, an extrusion coating method, a wire bar coating method, a spray coating method, a blade coating method, a knife coating method, or a curtain coating method.

The intermediate layer improves the coating property of the upper layer and also functions as an electric blocking layer. However, when the thickness is excessively large, an electric barrier becomes excessively strong, which may cause desensitization or an increase in potential due to the repeated use. Accordingly, when an intermediate layer is formed, the thickness may be set to from 0.1 μm to 3 μm. In this case, the intermediate layer may be used as the undercoat layer.

Charge Generation Layer

The charge generation layer includes, for example, a charge generation material and a binder resin. Examples of the charge generation material include phthalocyanine pigments such as metal-free phthalocyanine, chlorogallium phthalocyanine, hydroxygallium phthalocyanine, dichlorotin phthalocyanine, and titanyl phthalocyanine. Particularly, there are exemplified a chlorogallium phthalocyanine crystal having strong diffraction peaks at least at Bragg angles (2θ±0.2°) of 7.4°, 16.6°, 25.5°, and 28.3° with respect to CuKα characteristic X-ray, a metal-free phthalocyanine crystal having strong diffraction peaks at least at Bragg angles (2θ±0.2°) of 7.7°, 9.3°, 16.9°, 17.5°, 22.4°, and 28.8° with respect to CuKα characteristic X-ray, a hydroxygallium phthalocyanine crystal having strong diffraction peaks at least at Bragg angles (2θ±0.2°) of 7.5°, 9.9°, 12.5°, 16.3°, 18.6°, 25.1°, and 28.3° with respect to CuKα characteristic X-ray, and a titanyl phthalocyanine crystal having strong diffraction peaks at least at Bragg angles (2θ±0.2°) of 9.6°, 24.1°, and 27.2° with respect to CuKα characteristic X-ray. Other examples of the charge generation material include quinone pigments, perylene pigments, indigo pigments, bisbenzimidazole pigments, anthrone pigments, and quinacridone pigments. These charge generation materials may be used singly or in mixture of two or more types.

Examples of the binder resin constituting the charge generation layer include polycarbonate resins such as a bisphenol-A and a bisphenol-Z, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio of the charge generation material to the binder resin is, for example, preferably from 10:1 to 1:10.

In the formation of the charge generation layer, a coating liquid for charge generation layer formation is used in which the above components are added to a solvent.

As a method of dispersing the particles (for example, charge generation material) in the coating liquid for charge generation layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

Examples of the method of coating the undercoat layer with the coating liquid for charge generation layer formation include a dipping coating method, an extrusion coating method, a wire bar coating method, a spray coating method, a blade coating method, a knife coating method, and a curtain coating method.

The thickness of the charge generation layer is preferably set to from 0.01 μm to 5 μm, and more preferably from 0.05 μm to 2.0 μm.

Charge Transport Layer

The charge transport layer includes a charge transport material, and if necessary, a binder resin. When the charge transport layer corresponds to an outermost surface layer, the charge transport layer includes fluorine resin particles having the specific surface area as described above.

Examples of the charge transport material include hole transport substances e.g., oxadiazole derivatives such as 2,5-bis(p-diethylaminophenyl)-1,3,4-oxadiazole, pyrazoline derivatives such as 1,3,5-triphenyl-pyrazoline and 1-[pyridyl-(2)]-3-(p-diethylaminostyryl)-5-(p-diethylamino styryl)pyrazoline, aromatic tertiary amino compounds such as triphenylamine, N,N'-bis(3,4-dimethylphenyl)biphenyl-4-amine, tri(p-methylphenyl)aminyl-4-amine, and dibenzylaniline, aromatic tertiary diamino compounds such as N,N'-bis(3-methylphenyl)-N,N'-diphenylbenzidine, 1,2,4-triazine derivatives such as 3-(4'-dimethylaminophenyl)-5,6-di-(4'-methoxyphenyl)-1,2,4-triazine, hydrazone derivatives such as 4-diethylaminobenzaldehyde-1,1-diphenylhydrazone, quinazoline derivatives such as 2-phenyl-4-styryl-quinazoline, benzofuran derivatives such as 6-hydroxy-2,3-di(p-methoxyphenyl)benzofuran, α-stilbene derivatives such as p-(2,2-diphenylvinyl)-N,N-diphenylaniline, enamine derivatives, carbazole derivatives such as N-ethylcarbazole, and poly-N-vinylcarbazole and derivatives thereof; electron transport substances e.g., quinone compounds such as chloranil and bromoanthraquinone, tetracyanoquinodimethane compounds, fluorenone compounds such as 2,4,7-trinitrofluorenone and 2,4,5,7-tetranitro-9-fluorenone, xanthone compounds, and thiophene compounds; and polymers having a group composed of the above-described compounds as a main chain or side chain thereof. These charge transport materials may be used singly or in combination of two or more types.

Examples of the binder resin constituting the charge transport layer include insulating resins e.g., polycarbonate resins such as a bisphenol-A and a bisphenol-Z, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and chlorinated rubber; and organic photoconductive polymers such as polyvinyl carbazole, polyvinyl anthracene, and polyvinyl pyrene. These binder resins may be used singly or in mixture of two or more types.

The blending ratio of the charge transport material to the binder resin is, for example, preferably from 10:1 to 1:5.

The charge transport layer is formed using a coating liquid for charge transport layer formation in which the above components are added to a solvent.

As a method of dispersing the particles (for example, fluorine resin particles) in the coating liquid for charge transport layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Examples of the high-pressure homogenizer include a collision-type homogenizer in which a dispersion is dispersed under high pressure by liquid-liquid collision or liquid-wall collision, and a penetration-type homogenizer in which a dispersion is dispersed by allowing it to penetrate through a minute channel under high pressure.

As a method of coating the charge generation layer with the coating liquid for charge transport layer formation, a general method is used such as a dipping coating method, an extrusion coating method, a wire bar coating method, a spray coating method, a blade coating method, a knife coating method, or a curtain coating method.

The thickness of the charge transport layer is preferably set to from 5 μm to 50 μm, and more preferably from 10 μm to 40 μm.

Surface Protective Layer

First, the characteristics of the surface protective layer will be described.

An elastic deformation ratio R of the surface protective layer (outermost surface layer) satisfies the following Expression (1) (preferably the following Expression (1-2), and more preferably the following Expression (1-3)):

$$0.40 \leq R \leq 0.51 \quad \text{Expression (1)}$$

$$0.43 \leq R \leq 0.50 \quad \text{Expression (1-2)}$$

$$0.45 \leq R \leq 0.50 \quad \text{Expression (1-3)}$$

In the case in which the elastic deformation ratio R is 0.4 or greater, when images are repeatedly formed, an increase in the difference between a position having a large developer amount (for example, image part) and a position having a small developer amount (for example, non-image part) in the abrasion amount of the outermost surface layer of the electrophotographic photoreceptor is suppressed.

Meanwhile, in the case in which the elastic deformation ratio R is 0.5 or less, when images are repeatedly formed, an increase in the difference between a position having a large developer amount (for example, image part) and a position having a small developer amount (for example, non-image part) in the abrasion amount of the cleaning blade is suppressed.

The elastic deformation ratio R is adjusted by using in combination at least two types of reactive charge transport materials that are respectively selected from first reactive charge transport materials having a —OH group as a reactive functional group and from second reactive charge transport materials having a —$OCH_3$ group as a reactive functional group, and by, for example, 1) adjusting the blending ratio of the above at least two types of reactive charge transport materials, 2) adjusting the blending ratio of a curing catalyst, or the like.

The elastic deformation ratio R of the surface protective layer (outermost surface layer) is obtained as follows.

First, a plate-like sample is collected from a measurement target layer of the electrophotographic photoreceptor. Next, using a nanoindenter SA2 (manufactured by MTS Systems Corporation), a DCM head, and an equilateral triangular pyramid indenter made of diamond, an impression depth-stress curve is measured, and a load is applied at an impression depth of 500 nm. Next, with an impression depth D1 (nm) in a state in which the load is completely removed and a maximum impression depth of 500 nm under load, the elastic deformation ratio R is obtained through the expression $$R=(500-D1)/D1.$$

As for the surface protective layer (outermost surface layer), it is preferable that a Young's modulus M1 (GPa) when the surface protective layer is laminated may satisfy the following Expression (2) (preferably the following Expression (2-2), and more preferably the following Expression (2-3)).

$$3.8 \leq M1 \leq 5 \quad \text{Expression (2)}$$

$$4.0 \leq M1 \leq 5 \quad \text{Expression (2-2)}$$

$$4.0 \leq M1 \leq 4.5 \quad \text{Expression (2-3)}$$

When the Young's modulus M1 (GPa) of the surface protective layer (outermost surface layer) in a laminated state is adjusted to the above range, unevenness in image density due to the cleaning problem generated when repeatedly forming images is easily suppressed. It is thought that this is because the surface protective layer (outermost surface layer) has appropriate hardness.

The Young's modulus M1 (GPa) of the surface protective layer (outermost surface layer) in a laminated state is adjusted by, for example, using in combination at least two types of reactive charge transport materials that are respectively selected from first reactive charge transport materials having a —OH group as a reactive functional group and from second reactive charge transport materials having a —$OCH_3$ group as a reactive functional group, and by, for example, 1) adjusting the blending ratio of the above at least two types of reactive charge transport materials, 2) adjusting the blending ratio of a curing catalyst, 3) adjusting a temperature of the drying process, 4) adjusting a time of the drying process, or the like.

As for the surface protective layer (outermost surface layer), it is preferable that the relationship between the Young's modulus M1 (GPa) when the surface protective layer is laminated and a Young's modulus M2 (GPa) when the surface protective layer has been peeled off may satisfy the following Expression (3) (preferably the following Expression (3-2)).

$$M1 \leq 1.1 \times M2 \quad \text{Expression (3)}$$

$$0.9 \times M2 \leq M1 \leq M2 \quad \text{Expression (3-2)}$$

When the Young's modulus M1 (GPa) of the surface protective layer (outermost surface layer) in a laminated state and the Young's modulus M2 (GPa) when the surface protective layer has been peeled off satisfy the above relationship, unevenness in image density due to the cleaning problem generated when repeatedly forming images is easily suppressed. It is thought that this is because the surface protective layer (outermost surface layer) is suppressed from being warped and broken.

The Young's modulus M1 (GPa) of the surface protective layer (outermost surface layer) in a laminated state and the Young's modulus M2 (GPa) when the surface protective layer has been peeled off are adjusted by, for example, using in combination at least two types of reactive charge transport materials that are respectively selected from first reactive charge transport materials having a —OH group as a reactive functional group and from second reactive charge transport materials having a —$OCH_3$ group as a reactive functional group, and by, for example, 1) adjusting the blending ratio of the above at least two types of reactive charge transport materials, 2) adjusting the blending ratio of a curing catalyst, 3) adjusting a temperature of the drying process, 4) adjusting a time of the drying process, or the like.

Here, the Young's modulus M1 (GPa) of the surface protective layer (outermost surface layer) in a laminated state is a value that is obtained by measuring the Young's modulus of an outer circumferential surface of the electrophotographic photoreceptor as a finished product.

The Young's modulus M2 (GPa) of the charge transport layer (the electrophotographic photoreceptor in a state in which the outermost surface layer is removed) in a state in which the surface protective layer has been peeled off is a value that is obtained by measuring the Young's modulus of a measurement sample obtained by peeling-off the surface protective layer (outermost surface layer) from the electrophotographic photoreceptor as a finished product. The measurement of the Young's modulus is performed as follows.

Using a nanoindenter SA2 (manufactured by MTS Systems Corporation), a DON head, and an equilateral triangular pyramid indenter made of diamond, an impression depth-stress curve is measured, and a load is applied at a maximum impression depth of 500 nm. Next, the inclination of an unloading curve for the case in which the load is removed is obtained as a Young's modulus.

Next, the configuration of the surface protective layer will be described.

The surface protective layer is formed of a cured film of a composition including a reactive charge transport material. That is, the surface protective layer is formed of a charge-transporting cured film including a polymer (or cross-linked body) of a reactive charge transport material.

In addition, the surface protective layer may be formed of a cured film of a composition further including at least one type selected from guanamine compounds and melamine compounds from the viewpoint of improving the mechanical strength and increasing the lifespan of the electrophotographic photoreceptor. That is, the surface protective layer may be formed of a charge-transporting cured film including a polymer (cross-linked body) of a reactive charge transport material and at least one type selected from guanamine compounds and melamine compounds.

In addition, the surface protective layer may be formed of a cured film of a composition further including fluorine resin particles and a fluorinated alkyl group-containing copolymer from the viewpoint of improving the sliding and friction properties of the surface.

The reactive charge transport material will be described.

As for the reactive charge transport material, at least two types that are respectively selected from first reactive charge transport materials having a —OH group as a reactive functional group and from second reactive charge transport materials having a —$OCH_3$ group as a reactive functional group are employed.

Other than the two types of the first and second reactive charge transport materials, other reactive charge transport materials may be used in combination.

The reactive charge transport material has a reactive functional group. The first reactive charge transport materials have a —OH group as a reactive functional group, the second reactive charge transport materials have a —$OCH_3$ group as a reactive functional group, and other reactive charge transport materials have other reactive functional groups (for example, —$NH_2$, —SH, and —COOH) as a reactive functional group other than a —OH group and an $OCH_3$ group.

Hereinafter, these reactive charge transport materials will be simply referred to as "reactive charge transport material" and described collectively.

The reactive charge transport material may preferably be a charge transport material having at least two (or three) reactive substituents. As described above, when the number of reactive functional groups is increased in the charge transport material, the crosslink density rises, and thus a cured film (cross-linked film) having higher strength is obtained. Particularly, when using a foreign substance removing member such as a blade member, the rotary torque of the electrophotographic photoreceptor is reduced, and thus abrasion of the foreign substance removing member and abrasion of the electrophotographic photoreceptor are suppressed. The detailed reason for this is not clear, but it is presumed that this is because when the number of reactive functional groups is increased, a cured film having a high crosslink density is obtained, and thus molecular motion of the top surface of the electrophotographic photoreceptor is suppressed and a reciprocal action with the surface molecules of the blade member weakens.

The reactive charge transport material is preferably a compound represented by the following Formula (I) from the viewpoint of suppressing abrasion of the foreign substance removing member and suppressing abrasion of the electrophotographic photoreceptor.

$$F—((—R^{13}—X)_{n1}(R^{14})_{n2}—Y)_{n3} \quad (I)$$

In Formula (I), F represents an organic group (charge transport skeleton) derived from a compound having a charge transport ability, $R^{13}$ and $R^{14}$ each independently represent a linear or branched alkylene group having from 1 to 5 carbon atoms, n1 represents 0 or 1, n2 represents 0 or 1, and n3 represents an integer of from 1 to 4. X represents oxygen, NH, or a sulfur atom, and Y represents a reactive functional group.

In Formula (I), in the organic group derived from a compound having a charge transport ability that is represented by F, as the compound having a charge transport ability, arylamine derivatives are preferably used. As the arylamine derivative, a triphenylamine derivative and a tetraphenylbenzidine derivative are preferably used.

In addition, the compound represented by Formula (I) is preferably a compound represented by the following Formula (II). Particularly, the compound represented by Formula (II) has excellent charge mobility and excellent stability with respect to oxidation and the like.

(II)

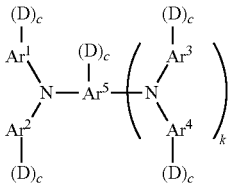

In Formula (II), $Ar^1$ to $Ar^4$ may be the same as, or different from each other, and each independently represent a substituted or unsubstituted aryl group, $Ar^5$ represents a substituted or unsubstituted aryl group, or a substituted or unsubstituted arylene group, D represents $—(—R—X)_{n1}(R^{14})_{n2}—Y$, c independently represents 0 or 1, k represents 0 or 1, and the total number of D is from 1 to 4. In addition, $R^{13}$ and $R^{14}$ each independently represent a linear or branched alkylene group having from 1 to 5 carbon atoms, n1 represents 0 or 1, n2 represents 0 or 1, X represents oxygen, NH, or a sulfur atom, and Y represents a reactive functional group.

Here, as a substituent in the substituted aryl group or substituted arylene group, other than D, an alkyl group having from 1 to 4 carbon atoms, an alkoxy group having from 1 to 4 carbon atoms, a substituted or unsubstituted aryl group having from 6 to 10 carbon atoms, and the like are used.

In Formula (II), "$—(—R—X)_{n1}(R^{14})_2—Y$" represented by D is the same as in Formula (I), and $R^{13}$ and $R^{14}$ each independently represent a linear or branched alkylene group having from 1 to 5 carbon atoms. In addition, n1 is preferably 1. In addition, n2 is preferably 1. In addition, X is preferably oxygen.

The total number of D in Formula (II) corresponds to n3 in Formula (I), and is preferably from 2 to 4, and more preferably from 3 to 4.

In addition, in Formula (I) and Formula (II), when the total number of D is from 2 to 4, and preferably from 3 to 4 in one molecule, the crosslink density rises, and thus a cross-linked film having higher strength is easily obtained. Particularly, when using a blade member for removing foreign substances, the rotary torque of the electrophotographic photoreceptor is reduced, and thus abrasion of the blade member and abrasion of the electrophotographic photoreceptor are suppressed. The detailed reason for this is not clear, however, it is presumed that this is because, as described above, when the number of reactive functional groups is increased, a cured film having a high crosslink density is obtained, and thus molecular motion of the top surface of the electrophotographic photoreceptor is suppressed and a reciprocal action with the surface molecules of the blade member weakens.

In Formula (II), each of $Ar_1$ to $Ar_4$ is preferably one of compounds represented by the following Formulae (1) to (7). The following Formulae (1) to (7) are shown together with "$-(D)_c$" that may be connected to each of $Ar_1$ to $Ar_4$.

(1)

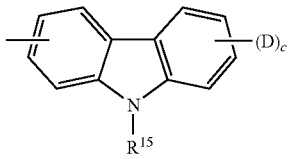

(2)

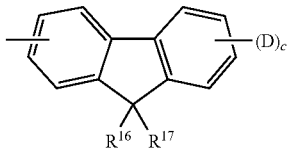

(3)

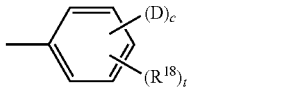

(4)

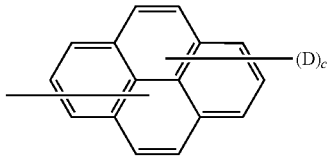

(5)

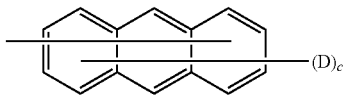

(6)

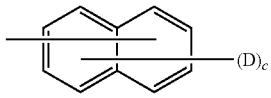

(7)

$—Ar—(Z')_s—Ar—(D)_c$

In Formulae (1) to (7), $R^{15}$ represents one type selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms, $R^{16}$ to $R^{18}$ each represent one type selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, Ar represents a substituted or unsubstituted arylene group, D and c are the same as "D" and "c" in Formula (II), respectively, s represents 0 or 1, and t represents an integer of from 1 to 3.

Here, Ar in Formula (7) is preferably the one represented by the following Formula (8) or (9).

(8)

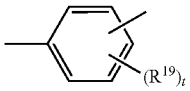

(9)

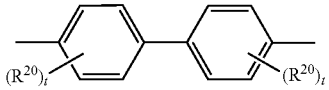

In Formulae (8) and (9), $R^{19}$ and $R^{20}$ each represent one type selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t represents an integer of from 1 to 3.

In addition, Z' in Formula (7) is preferably the one represented by any one of the following Formulae (10) to (17).

(10)

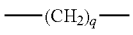

(11)

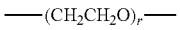

(12)

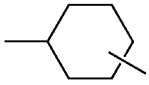

(13)

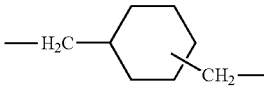

(14)

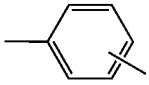

(15)

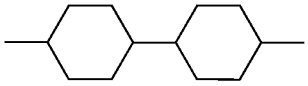

(16)

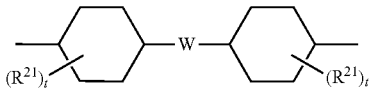

(17)

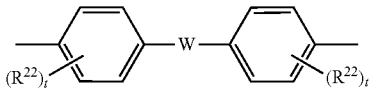

In Formulae (10) to (17), $R^{21}$ and $R^{22}$ each represent one type selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, an aralkyl group having from 7 to 10 carbon atoms, and a halogen atom, W represents a divalent group, q and r each represent an integer of from 1 to 10, and t represents an integer of from 1 to 3.

W in the above Formulae (16) and (17) is preferably any one of divalent groups represented by the following Formulae (18) to (26). However, in Formula (25), u represents an integer of from 0 to 3.

(18) $—CH_2—$

(19) $—C(CH_3)_2—$

(20) —O—

(21) —S—

(22) $—C(CF_3)_2—$

(23) $—Si(CH_3)_2—$ (24)

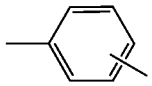

(25)

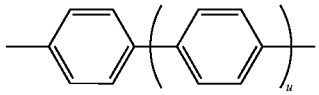

(26)

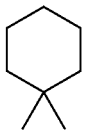

In addition, in Formula (II), is an aryl group represented by any one of the aryl groups (1) to (7) exemplified in the description of $Ar^1$ to $Ar^4$ when k is 0. When k is 1, $Ar^y$ is an arylene group obtained by removing a hydrogen atom from one of the aryl groups (1) to (7).

Specific examples of the compound represented by Formula (I) include the following compounds. The compound represented by the above Formula (I) is not limited thereto.

I-1

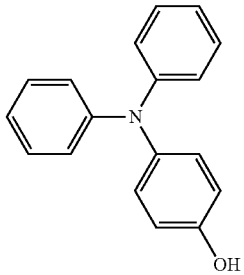

I-2

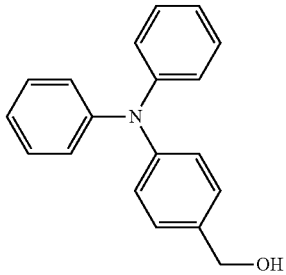

-continued
I-3
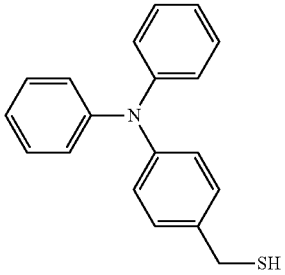
I-4
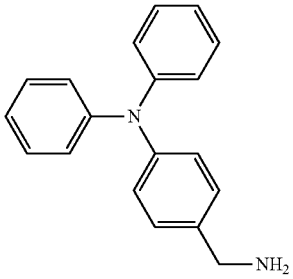
I-5
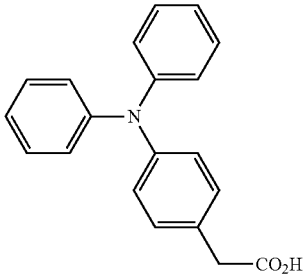
I-6
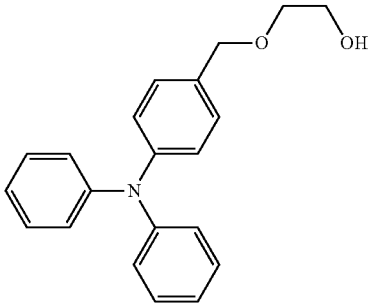
I-7
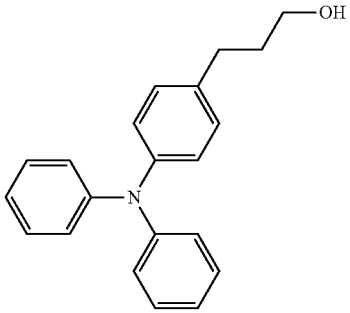
-continued
I-8
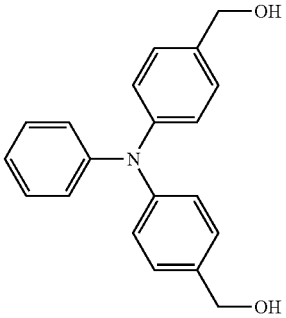
I-9
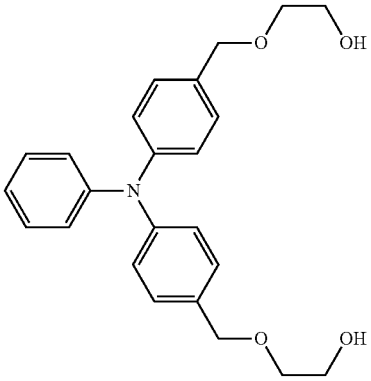
I-10
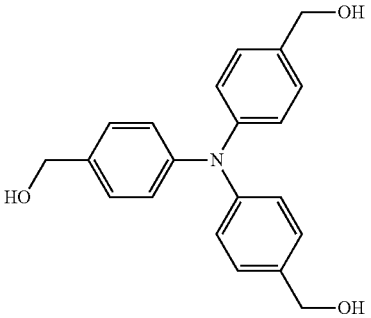
I-11
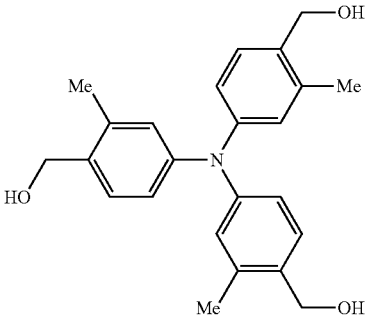

-continued
I-12
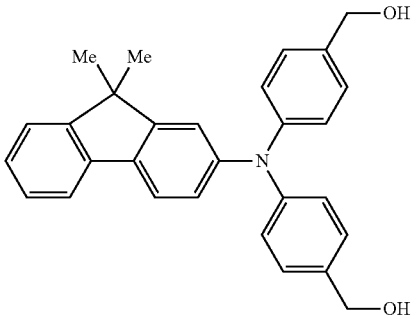
I-13
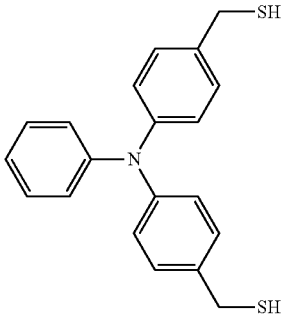
I-14
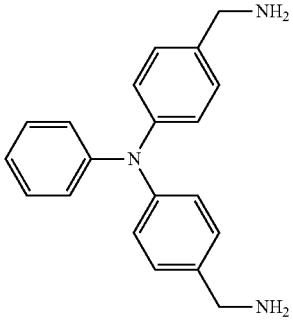
I-15
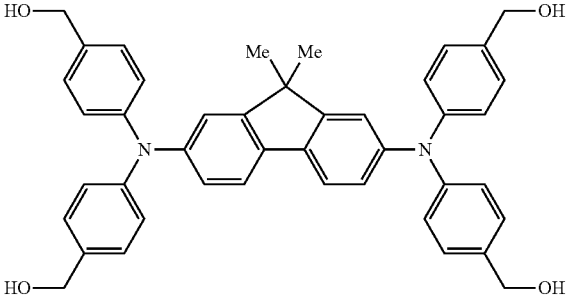
I-16
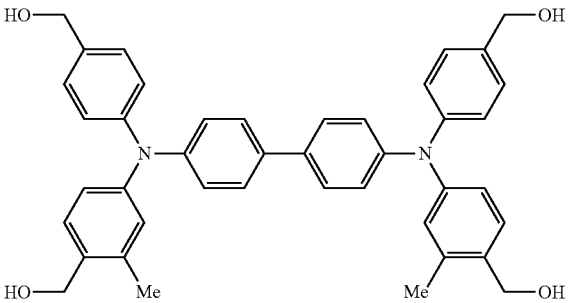
-continued
I-17
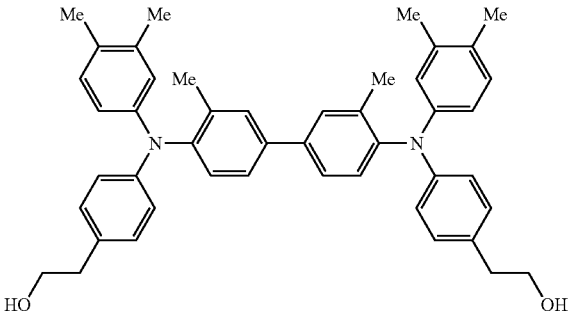
I-18
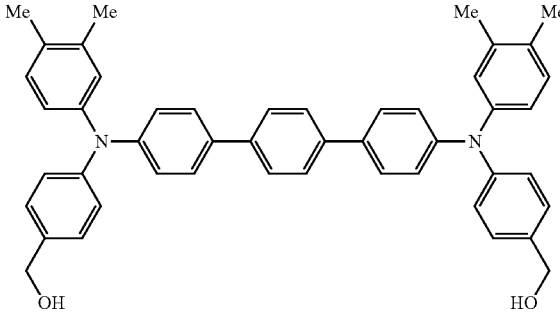
I-19
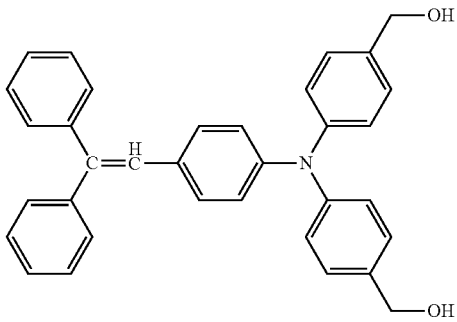
I-20
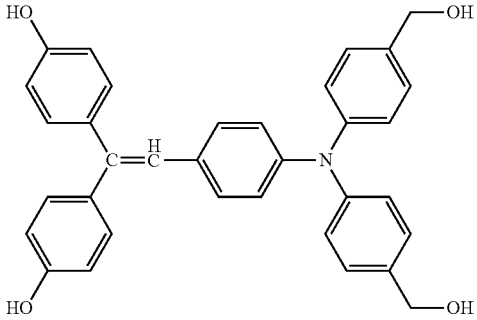

-continued
I-21
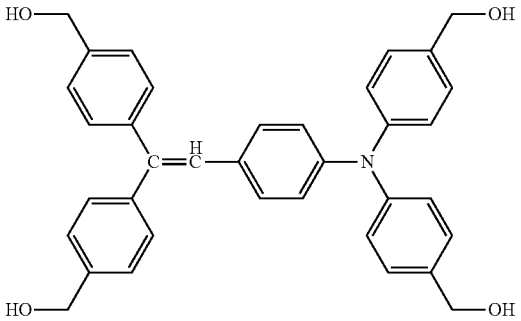
I-22
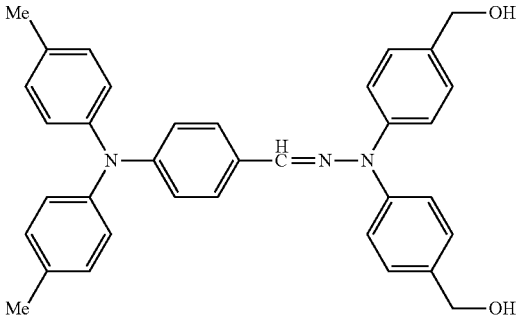
I-23
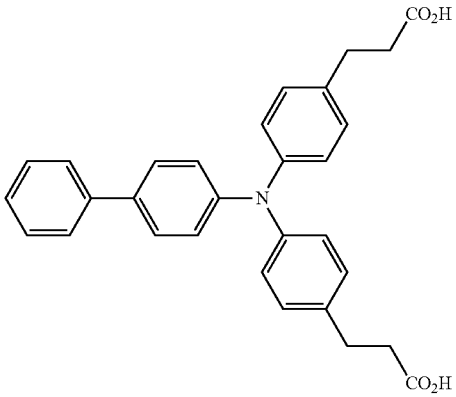
I-24
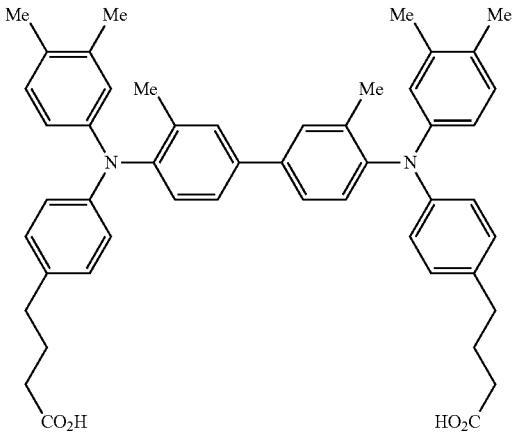
-continued
I-25
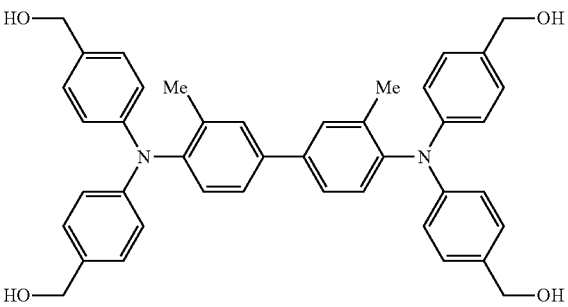
I-26
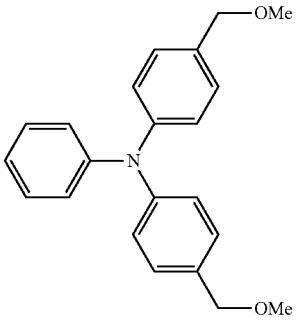
I-27
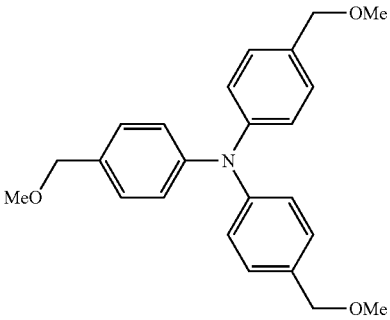
I-28
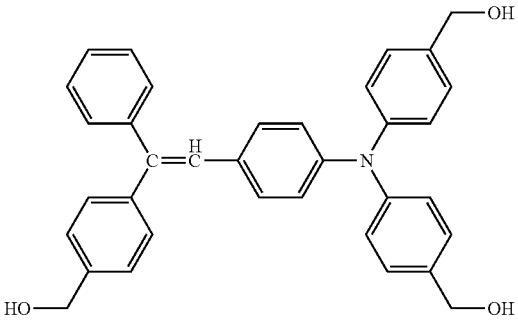

-continued

I-29

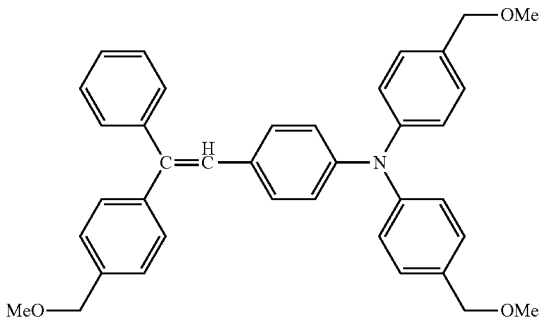

I-30

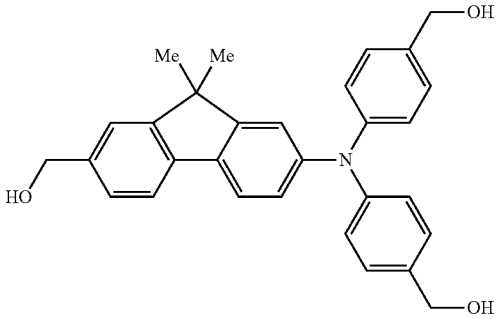

I-31

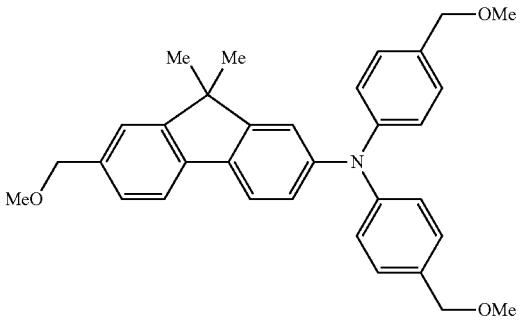

I-32

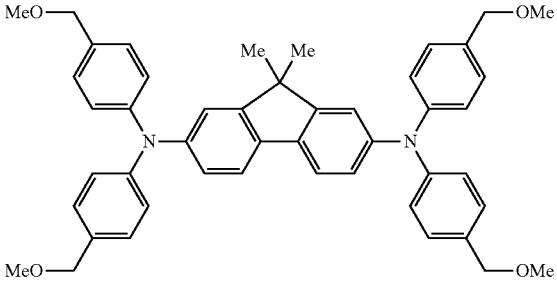

I-33

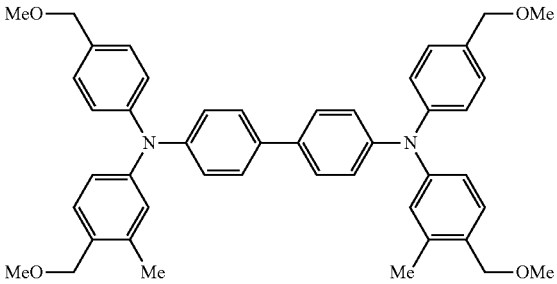

-continued

I-34

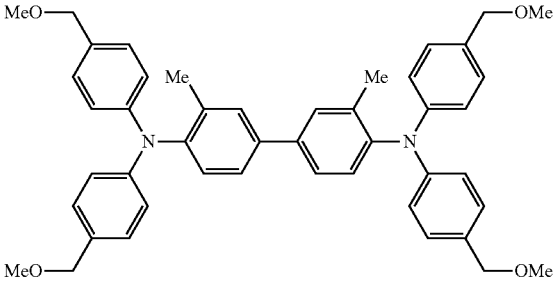

The content of the reactive charge transport material (solid content concentration in the coating liquid) is, for example, 80% by weight or greater, preferably 90% by weight or greater, and more preferably 95% by weight or greater with respect to all of the constituent components of the layer (solid content) excluding the fluorine resin particles and the fluorinated alkyl group-containing copolymer. When the solid content concentration is less than 90% by weight, the electric characteristics may deteriorate. The upper limit of the content of the reactive charge transport material is not limited as long as other additives effectively function, and the content is preferably large.

Here, among the reactive charge transport materials, it is preferable that the proportion of the first reactive charge transport material having a —OH group as a reactive functional group to the second reactive charge transport material having a —$OCH_3$ group as a reactive functional group (first reactive charge transport material/second reactive charge transport material) may be 2 to 20, preferably 2 to 15, and more preferably 3 to 10 in terms of the weight ratio.

When the first reactive charge transport material and the second reactive charge transport material are used in combination in the above proportion, the elastic deformation ratio is adjusted so as to satisfy the above Expression (1), and thus unevenness in image density due to the cleaning problem generated when repeatedly forming images is easily suppressed.

When other reactive charge transport materials are used in combination with the first reactive charge transport material and the second reactive charge transport material, other reactive charge transport materials are used in combination in an amount of 10% by weight or less with respect to all of the reactive charge transport materials.

Next, the guanamine compound will be described.

The guanamine compound is a compound having a guanamine skeleton (structure). Examples thereof include acetoguanamine, benzoguanamine, formoguanamine, steroguanamine, spiroguanamine, and cyclohexylguanamine.

Particularly, the guanamine compound is preferably at least one type of a compound represented by the following Formula (A) and an oligomer thereof. Here, the oligomer is an oligomer in which the compound represented by Formula (A) is polymerized as a structural unit, and the polymerization degree thereof is, for example, from 2 to 200 (preferably from 2 to 100). The compound represented by Formula (A) may be used singly or in combination of two or more types. Particularly, when the compound represented by Formula (A) is used in mixture of two or more types, or used as an oligomer having the compound as a structural unit, the solubility in a solvent is improved.

(A)

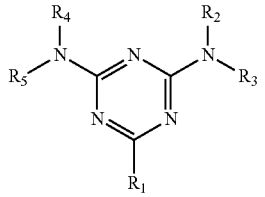

In Formula (A), R represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R_2$ to $R_5$ each independently represent a hydrogen atom, —$CH_2$—OH, or —$CH_2$—O—$R_6$. $R_6$ represents a linear or branched alkyl group having from 1 to 10 carbon atoms.

In Formula (A), the alkyl group represented by $R_1$ has from 1 to 10 carbon atoms, preferably from 1 to 8 carbon atoms, and more preferably from 1 to 5 carbon atoms. The alkyl group may be linear or branched.

In Formula (A), the phenyl group represented by $R_1$, has from 6 to 10 carbon atoms, and preferably from 6 to 8 carbon atoms. Examples of the substituent of the phenyl group include a methyl group, an ethyl group, and a propyl group.

In Formula (A), the alicyclic hydrocarbon group represented by $R_1$ has from 4 to 10 carbon atoms, and preferably from 5 to 8 carbon atoms. Examples of the substituent of the alicyclic hydrocarbon group include a methyl group, an ethyl group, and a propyl group.

In Formula (A), in "—$CH_2$—O—$R_6$" represented by $R_2$ to $R_5$, the alkyl group represented by $R_6$ has from 1 to 10 carbon atoms, preferably from 1 to 8 carbon atoms, and more preferably from 1 to 6 carbon atoms. In addition, the alkyl group may be linear or branched. Preferred examples thereof include a methyl group, an ethyl group, and a butyl group.

The compound represented by Formula (A) is particularly preferably a compound in which $R_1$ represents a substituted or unsubstituted phenyl group having from 6 to 10 carbon atoms, and $R_2$ to $R_5$ each independently represent —$CH_2$—O—$R_6$. $R_6$ is preferably selected from a methyl group and an n-butyl group.

The compound represented by Formula (A) is synthesized by, for example, a known method using guanamine and formaldehyde (for example, see Experimental Chemical Lecture, 4$^{th}$ Edition, vol. 28, p. 430, edited by The Chemical Society of Japan).

Hereinafter, exemplary compounds (A)-1 to (A)-42 will be shown as specific examples of the compound represented by Formula (A), but this exemplary embodiment is not limited thereto. Although the following specific examples are in the form of a monomer, the compounds may be oligomers having these monomers as a structural unit. In the following exemplary compounds, "Me" represents a methyl group, "Eu" represents a butyl group, and "Ph" represents a phenyl group.

(A)-1

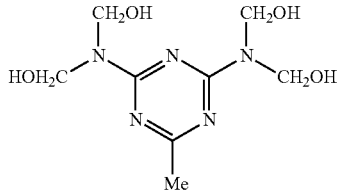

-continued (A)-2

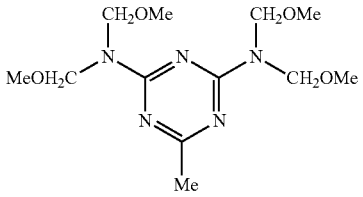

(A)-3

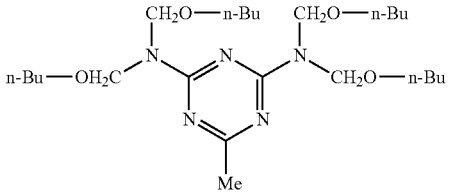

(A)-4

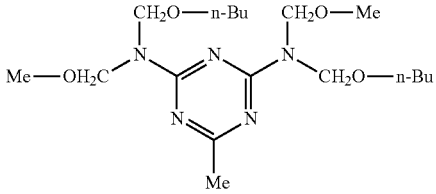

(A)-5

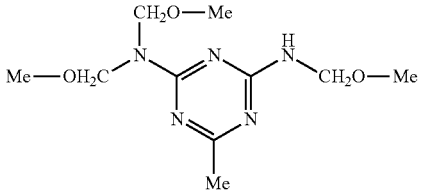

(A)-6

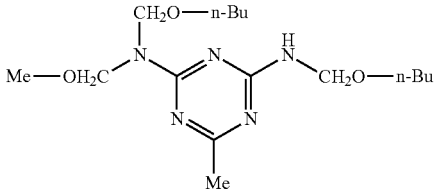

(A)-7

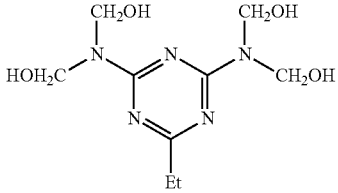

(A)-8

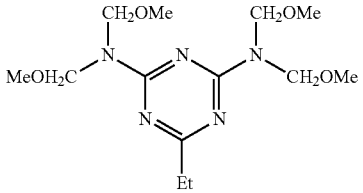

(A)-9

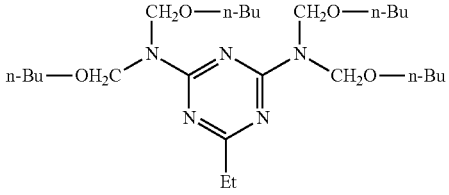

-continued
(A)-10
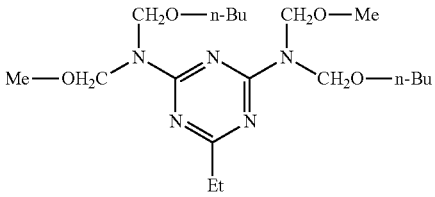
(A)-11
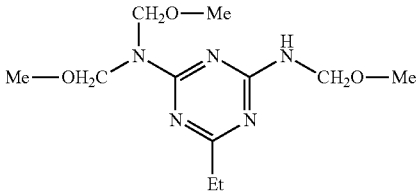
(A)-12
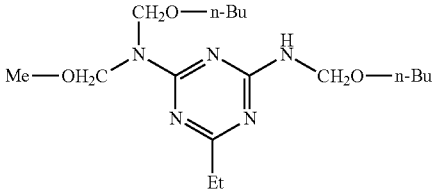
(A)-13
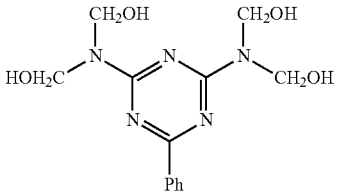
(A)-14
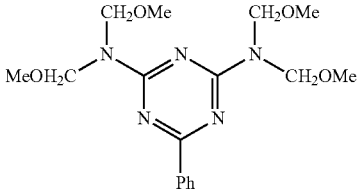
(A)-15
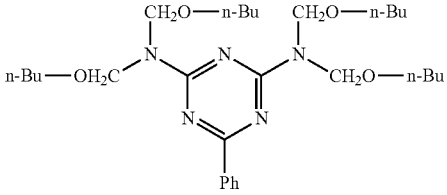
(A)-16
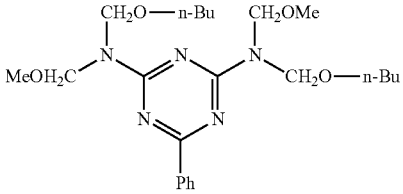
(A)-17
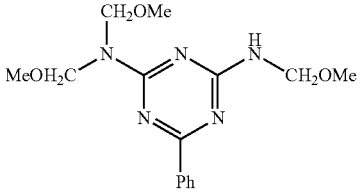
-continued
(A)-18
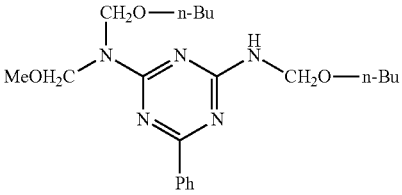
(A)-19
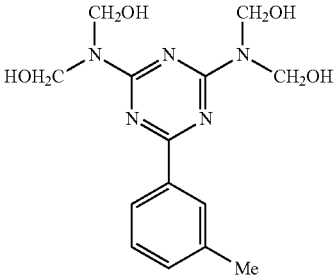
(A)-20
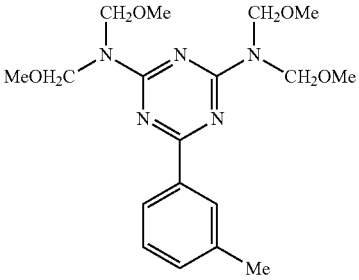
(A)-21
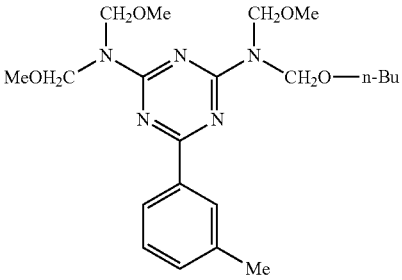
(A)-22
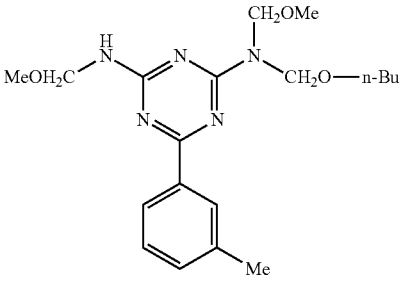
(A)-23
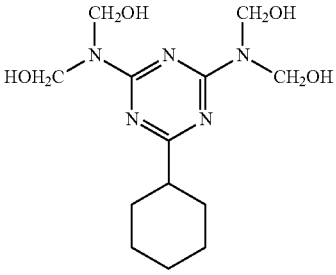

-continued
(A)-24
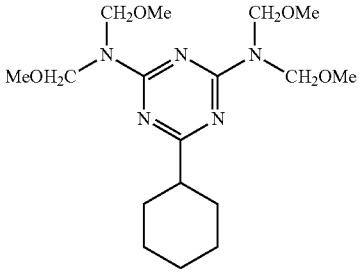
(A)-25
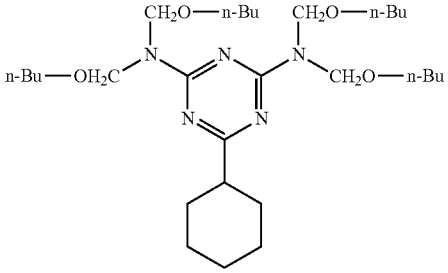
(A)-26
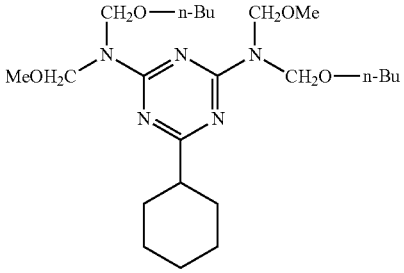
(A)-27
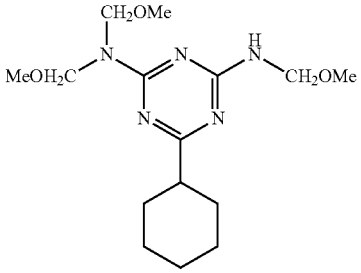
(A)-28
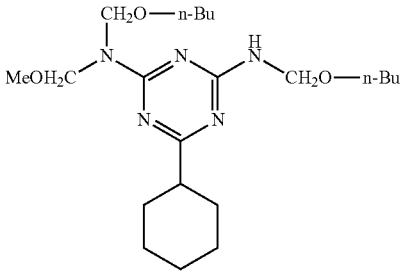
-continued
(A)-29
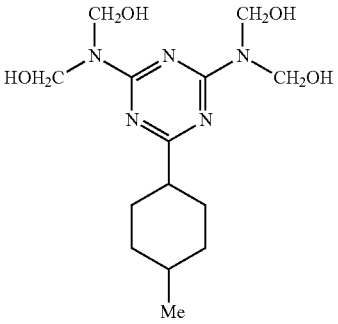
(A)-30
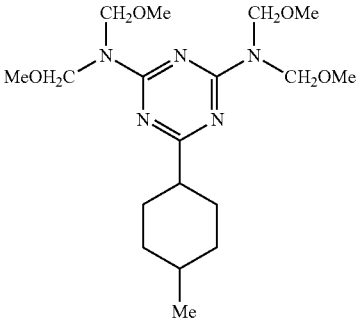
(A)-31
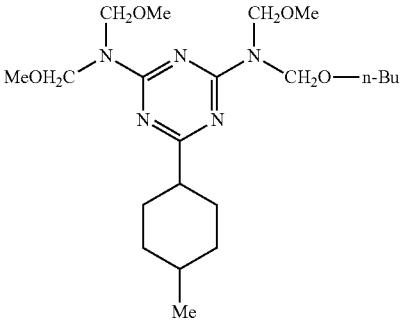
(A)-32
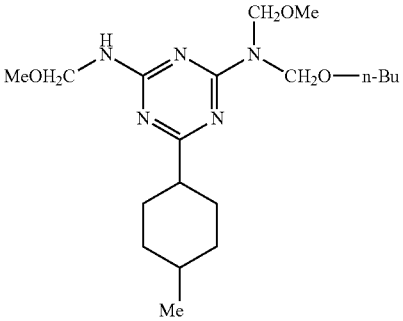
(A)-33
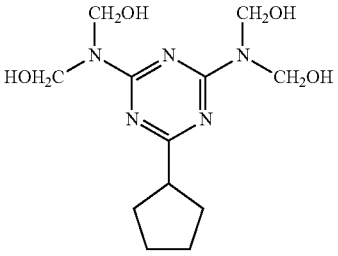

-continued (A)-34

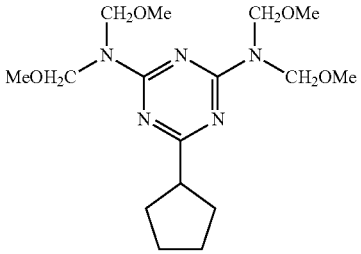

(A)-35

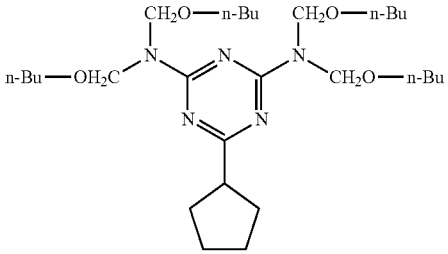

(A)-36

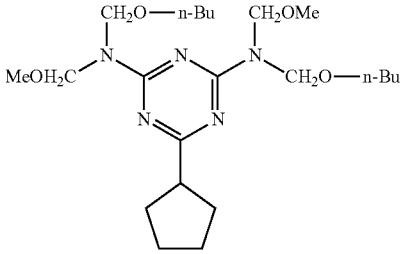

(A)-37

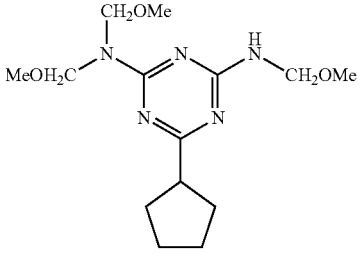

(A)-38

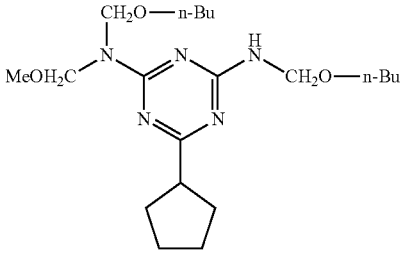

(A)-39

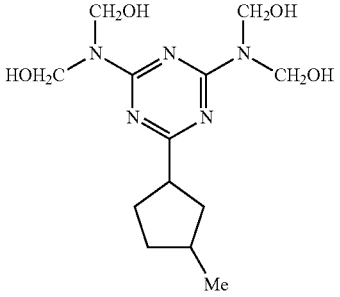

-continued (A)-40

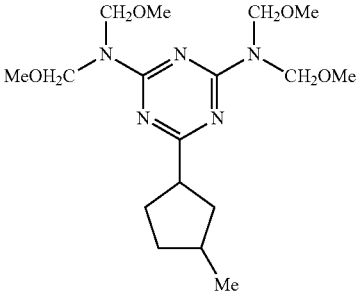

(A)-41

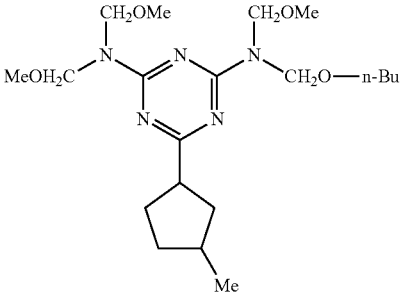

(A)-42

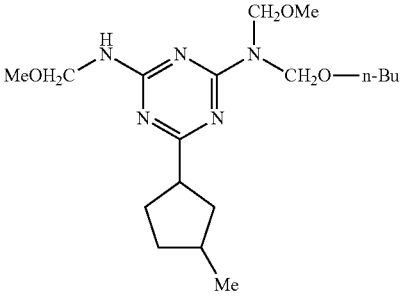

Examples of the commercially available product of the compound represented by Formula (A) include SUPER BECKAMINE (R) L-148-55, SUPER BECKAMINE (R) 13-535, SUPER BECKAMINE (R) L-145-60, and SUPER BECKAMINE (R) TD-126 (all manufactured by DIC Corporation); and NIKALAC BL-60, and NIKALAC BX-4000 (all manufactured by Nippon Carbide Industries Co., Inc.).

In addition, the compound represented by Formula (A) (including oligomers) may be dissolved in an appropriate solvent such as toluene, xylene or ethyl acetate, and washed with distilled water, ion exchange water or the like, or may be treated with an ion exchange resin, in order to remove the effect of a residual catalyst after synthesizing the compound or purchasing the commercially available product.

Next, the melamine compound will be described.

The melamine compound has a melamine skeleton (structure), and is particularly preferably at least one type of a compound represented by the following Formula (B) and an oligomer thereof. Here, the oligomer is an oligomer in which the compound represented by Formula (B) is polymerized as a structural unit as in the case of the compound represented by Formula (A), and the polymerization degree thereof is, for example, from 2 to 200 (preferably from 2 to 100). The compound represented by Formula (B) or an oligomer thereof may be used singly or in combination of two or more types. In addition, the compound represented by Formula (B) or an oligomer thereof may be used in combination of a compound represented by Formula (A) or an oligomer thereof. Particularly, when the compound represented by Formula (B) is used in mixture of two or more types, or used as an oligomer having the compound as a structural unit, the solubility in a solvent is improved.

(B)

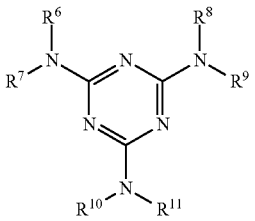

In Formula (B), $R^6$ to $R^{11}$ each independently represent a hydrogen atom, —$CH_2$—OH, —$CH_2$—O—$R^{12}$ or —O—$R^{12}$, and $R^{12}$ represents an alkyl group having from 1 to 5 carbon atoms that may be branched. Examples of the alkyl group include a methyl group, an ethyl group, and a butyl group.

The compound represented by Formula (B) is synthesized by, for example, a known method using melamine and formaldehyde (for example, in the same manner as in the case of the melamine resin as described in Experimental Chemical Lecture, $4^{th}$ Edition, vol. 28, p. 430).

Hereinafter, exemplary compounds (B)-1 to (B)-8 will be shown as specific examples of the compound represented by Formula (B), but this exemplary embodiment is not limited thereto. Although the following specific examples are in the form of a monomer, the compounds may be oligomers having these monomers as a structural unit.

(B)-1

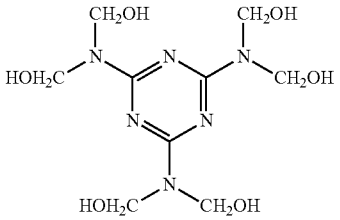

(B)-2

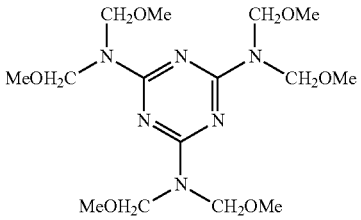

(B)-3

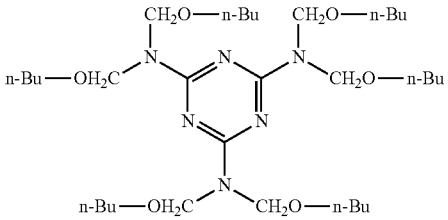

-continued (B)-4

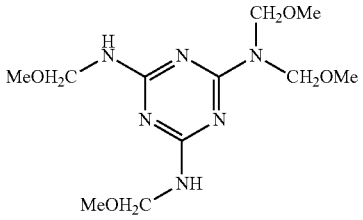

(B)-5

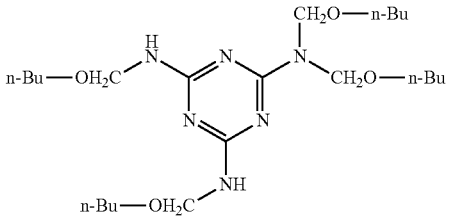

(B)-6

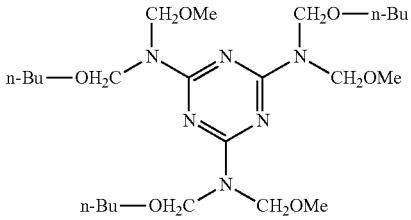

(B)-7

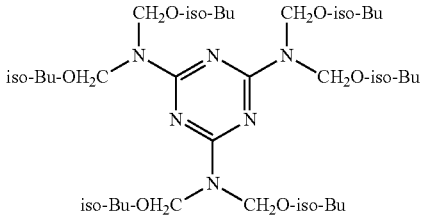

(B)-8

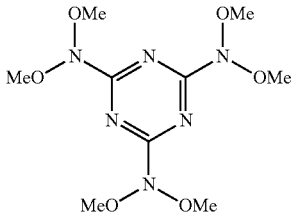

Examples of the commercially available product of the compound represented by Formula (B) include SUPER-MELAMI No. (manufactured by NOF Corporation), SUPER BECKAMINE (R) TD-139-60 (manufactured by DIC Corporation), U-VAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.).

In addition, the compound represented by Formula (B) (including oligomers) may be dissolved in an appropriate solvent such as toluene, xylene or ethyl acetate, and washed with distilled water, ion exchanged water or the like, or may be treated with an ion exchange resin, in order to remove the effect of a residual catalyst after synthesizing the compound or purchasing the commercially available product.

Here, the content (solid content concentration in the coating liquid) of at least one type selected from the guanamine compound (compound represented by Formula (A)) and the melamine compound (compound represented by Formula (B)) may be, for example, from 0.1% by weight to 5% by weight, and preferably from 1% by weight to 3% by weight with respect to all of the constituent components of the layer (solid content) excluding the fluorine resin particles and the fluorinated alkyl group-containing copolymer. When the solid content concentration is less than 0.1% by weight, a compact film is not easily obtained, and thus it is difficult to obtain sufficient strength. When the solid content concentration is greater than 5% by weight, the electric characteristics and ghosting resistance (unevenness in density due to image history) deteriorate in some cases.

Next, a description of will be made of the fluorine resin particles.

The fluorine resin particles are not particularly limited, and examples thereof include particles of polytetrafluoroethylene, a perfluoroalkoxy fluorine resin, polychlorotrifluoroethylene, polyvinylidene fluoride, polydichlorodifluoroethylene, tetrafluoroethylene-perfluoroalkylvinyl ether copolymers, tetrafluororoethylene-hexafluoropropylene copolymers, tetrafluoroethylene-ethylene copolymers, and tatrafluoroethylene-hexafluoropropylene-perfluoroalkylvinyl ether copolymers.

The fluorine resin particles may be used singly or in combination of two or more types.

The weight average molecular weight of the fluorine resin constituting the fluorine resin particles may be, for example, from 3,000 to 5,000,000.

The average primary particle diameter of the fluorine resin particles may be, for example, from 0.01 μm to 10 μm, and preferably from 0.05 μm to 2.0 μm.

The average primary particle diameter of the fluorine resin particles is a value that is measured at a refractive index of 1.35 using a laser diffraction-type particle size distribution measurement apparatus LA-700 (manufactured by Horiba, Ltd.) with a measurement liquid obtained by dilution with the same solvent as that of a dispersion in which the fluorine resin particles are dispersed.

Examples of the commercially available product of the fluorine resin particles include Lubron series (manufactured by Daikin Industries, Ltd.), Teflon (registered trade mark) series (manufactured by Du Pont Company), and Dyneon series (manufactured by Sumitomo 3M Ltd.).

The content of the fluorine resin particles may be, for example, from 1% by weight to 30% by weight, and preferably from 2% by weight to 20% by weight with respect to all of the constituent components of the layer (solid content).

Next, the fluorinated alkyl group-containing copolymer will be described.

The fluorinated alkyl group-containing copolymer may preferably be a fluorinated alkyl group-containing copolymer having repeating units represented by the following Structural Formula A and Structural Formula B.

The fluorinated alkyl group-containing copolymer is a material functioning as a dispersant of the fluorine resin particles. In place of the fluorinated alkyl group-containing copolymer, a dispersant of the fluorine resin particles may be applied.

Structural Formula A

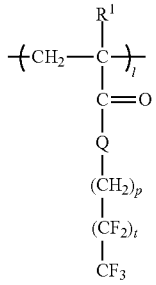

Structural Formula B

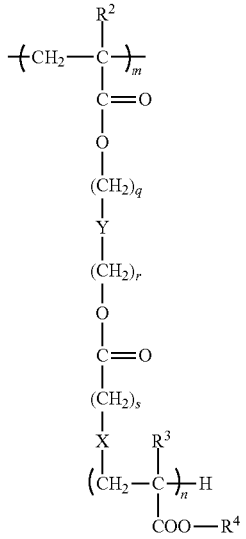

In Structural Formula A and Structural Formula B, $R^1$, $R^2$, $R^3$, and $R^4$ each independently represent a hydrogen atom or an alkyl group.

X represents an alkylene chain, a halogen-substituted alkylene chain, —S—, —O—, —NH—, or a single bond.

Y represents an alkylene chain, a halogen-substituted alkylene chain, —($C_zH_{2z-1}$(OH))—, or a single bond.

Q represents —O— or —NH—.

l, m, and n each independently represent an integer of 1 or greater.

p, q, r, ands each independently represent 0 or an integer of 1 or greater.

t represents an integer of from 1 to 7.

z represents an integer of 1 or greater.

Here, as the group represented by $R^1$, $R^2$, $R^3$, and $R^4$, a hydrogen atom, a methyl group, and an ethyl group are preferable, and among them, a methyl group is more preferable.

As the alkylene chain (unsubstituted alkylene chain, halogen-substituted alkylene chain) represented by X and Y, an alkylene chain having from 1 to 10 carbon atoms is preferable.

z in —($C_2H_{2z-1}$(OH))— represented by Y may preferably represent an integer of from 1 to 10.

p, q, r, and s each independently may preferably represent 0 or an integer of from 1 to 10.

In the fluorinated alkyl group-containing copolymer, the content ratio of Structural Formula (A) to Structural Formula (B), that is, l:m is preferably from 1:9 to 9:1, and more preferably from 3:7 to 7:3.

In Structural Formula (A) and Structural Formula (B), examples of the alkyl group represented by $R^1$, $R^2$, $R^3$, and $R^4$ include a methyl group, an ethyl group, and a propyl group.

As $R^1$, $R^2$, $R^3$, and $R^4$, a hydrogen atom and a methyl group are preferable, and among them, a methyl group is more preferable.

The fluorinated alkyl group-containing copolymer may further contain a repeating unit represented by Structural Formula (C). The content of Structural Formula (C) is preferably from 10:0 to 7:3, and more preferably from 9:1 to 7:3 in terms of the ratio between the total content of Structural Formula (A) and Structural Formula (B), that is, l+m and the content of Structural Formula (C) (l+m: z).

Structural Formula (C)

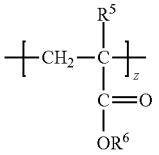

In Structural Formula (C), $R^5$ and $R^6$ represent a hydrogen atom or an alkyl group. z represents an integer of 1 or greater.

As the group represented by $R^5$ and $R^6$, a hydrogen atom, a methyl group, and an ethyl group are preferable, and among them, a methyl group is more preferable.

Examples of the commercially available product of the fluorinated alkyl group-containing copolymer include GF300 and GF400 (all manufactured by TOAGOSEI Co., Ltd.); Surflon series (manufactured by AGC Seimi Chemical Co., Ltd); F-tergent series (manufactured by Neos Co., Ltd.); PF series (manufactured by Kitamura Chemicals Co., Ltd.); Megafac series (manufactured by DIC Corporation); and FC series (manufactured by 3M Company).

The fluorinated alkyl group-containing copolymer may be used singly or in combination of two or more types.

The weight average molecular weight of the fluorinated alkyl group-containing copolymer may be, for example, from 2,000 to 250,000, and preferably from 3,000 to 150,000.

The weight average molecular weight of the fluorinated alkyl group-containing copolymer is measured by gel permeation chromatography (GPC).

The content of the fluorinated alkyl group-containing copolymer may be, for example, from 0.5% by weight to 10% by weight, and preferably from 1% by weight to 7% by weight with respect to the weight of the fluorine resin particles.

Hereinafter, a more detailed description will be made of the surface protective layer.

An antioxidant may be preferably added to the surface protective layer to, for example, suppress a deterioration due to oxidizing gas such as ozone generated in a charging device.

Examples of the antioxidant include known antioxidants such as hindered phenol antioxidants, aromatic amine antioxidants, hindered amine antioxidants, organic sulfur antioxidants, phosphite antioxidants, dithiocarbamate antioxidants, thiourea antioxidants, and benzimidazole antioxidants.

In the surface protective layer, a phenol resin, a urea resin, an alkyd resin, and the like may be used in combination with a reactive charge transport material (for example, compound represented by Formula (I)). In addition, in order to improve the strength, it is effective to copolymerize a compound having more functional groups in one molecule, such as spiroacetal guanamine resins (for example, "CTU-GUANAMINE", manufactured by Ajinomoto Fine-Techno Co., Inc.), with the materials of the crosslinked substance.

In the surface protective layer, other thermosetting resins such as a phenol resin may be mixed in order to prevent excessive adsorption of the gas generated by electric discharge and to effectively suppress oxidation due to the gas generated by electric discharge.

A surfactant may be preferably added to the surface protective layer. The surfactant is not particularly limited as long as it contains at least one structure of a fluorine atom, an alkylene oxide structure, and a silicone structure. The surfactant preferably has two or more of the above structures, since such a surfactant has high affinity and high compatibility with an organic charge transport compound, thereby improving the film forming property of a coating liquid for surface protective layer formation and suppressing the formation of wrinkles and unevenness of the surface protective layer.

In the surface protective layer, in order to adjust the film forming property, flexibility, lubricity, and adhesion property, a coupling agent and a fluorine compound may be further used in mixture. Examples of the compounds include various silane coupling agents and commercially available silicone hard coating agents.

An alcohol-soluble resin may be added in order to improve the resistance against electric discharge gas, mechanical strength, scratch resistance, and particle dispersibility, control the viscosity, reduce the torque, control the abrasion amount, and extend the pot life (storability of the coating liquid for layer formation) in the surface protective layer.

Here, the alcohol-soluble resin means a resin that dissolves in an amount of 1% by weight or greater in an alcohol having 5 or less carbon atoms. Examples of the resin that is soluble in alcohol solvents include a polyvinyl acetal resin and a polyvinyl phenol resin.

Various particles may be added to the surface protective layer in order to reduce the residual potential or improve the strength. Examples of the particles include silicon-containing particles. The silicon-containing particles are particles containing silicon as a constituent element, and specific examples thereof include colloidal silica and silicone particles.

Oil such as silicone oil may be added to the surface protective layer with the same purpose.

Metal, metallic oxide, carbon black, and the like may be added to the surface protective layer.

The surface protective layer is preferably a cured film (cross-linked film) that is obtained by polymerizing (cross-linking) a reactive charge transport material, and if necessary, at least one type selected from a guanamine compound and a melamine compound using an acid catalyst. Examples of the acid catalyst include aliphatic carboxylic acids such as acetic acid, chloroacetic acid, trichloroacetic acid, trifluoroacetic acid, oxalic acid, maleic acid, malonic acid, and lactic acid, aromatic carboxylic acids such as benzoic acid, phthalic acid, terephtalic acid, and trimellitic acid, and aliphatic and aromatic sulfonic acids such as methanesulfonic acid, dodecylsulfonic acid, benzenesulfonic acid, dodecylbenzenesulfonic acid, and naphthalenesulfonic acid. Surfur-containing materials are preferably used.

Here, the blending ratio of the catalyst is preferably from 0.1% by weight to 50% by weight, and particularly preferably from 10% by weight to 30% by weight with respect to all of the constituent components of the layer (solid content) excluding the fluorine resin particles and the fluorinated alkyl group-containing copolymer. When the blending ratio is less than the above range, the catalytic activity is too low in some cases, and when the blending ratio is greater than the above range, light resistance deteriorates in some cases. The light resistance refers to a phenomenon in which when the photosensitive layer is exposed to foreign light such as interior light, the density is reduced in the part irradiated with the light. Although the cause thereof is not clear, it is assumed that this is because the same phenomenon as an optical memory effect occurs as in JP-A-5-099737.

The surface protective layer having the above configuration is formed using a coating liquid for surface protective layer formation in which the above components are mixed. The coating liquid for surface protective layer formation is prepared in a solvent-free manner. However, if necessary, the preparation may be performed using a solvent. Such a solvent is used singly or in a mixture of two or more types, and preferably has a boiling point of 100° C. or lower. As the solvent, particularly, at least one type of solvent having a hydroxyl group (for example, alcohols) may be used.

In addition, when obtaining the coating liquid by reacting the above components, only simple mixing and dissolving may be performed. However, heating may be performed for 10 minutes to 100 hours, and preferably 1 hour to 50 hours, at a temperature of room temperature (for example, 25° C.) to 100° C., and preferably 30° C. to 80° C. In addition, at this time, ultrasonic waves may also be preferably applied. In this manner, the reaction may proceed partially, and a film having less coating film defects with less unevenness in thickness is easily obtained.

In addition, the coating liquid for surface protective layer formation is applied using a known method such as a blade coating method, a wire bar coating method, a spray coating method, a dipping coating method, a bead coating method, an air knife coating method, or a curtain coating method, and if necessary, heating at a temperature of, for example, 100° C. to 170° C. is performed for curing, whereby the surface protective layer is obtained.

As described above, an example of the functional separation-type electrophotographic photoreceptor has been described, however, for example, when the single layer-type photosensitive layer (charge generation/charge transport layer) shown in FIG. 3 is formed, the content of the charge generation material is preferably from about 10% by weight to about 85% by weight, and more preferably from 20% by weight to 50% by weight. In addition, the content of the charge transport material is preferably from 5% by weight to 50% by weight.

A method of forming the single layer-type photosensitive layer is the same as the method of forming the charge generation layer or the charge transport layer. The thickness of the single layer-type photosensitive layer is preferably from about 5 μm to about 50 μm, and more preferably from 10 μm to 40 μm.

Image Forming Apparatus, Process Cartridge

An image forming apparatus according to this exemplary embodiment may include the electrophotographic photoreceptor according to this exemplary embodiment, a charging unit that charges a surface of the electrophotographic photoreceptor, a latent image forming unit that forms an electrostatic latent image on a charged surface of the electrophotographic photoreceptor, a developing unit that develops the electrostatic latent image formed on the surface of the electrophotographic photoreceptor with a toner to form a toner image, and a transfer unit that transfers the toner image formed on the surface of the electrophotographic photoreceptor onto a recording medium.

A process cartridge according to this exemplary embodiment may include the electrophotographic photoreceptor according to this exemplary embodiment, and a cleaning unit that cleans the electrophotographic photoreceptor.

Figure 4:
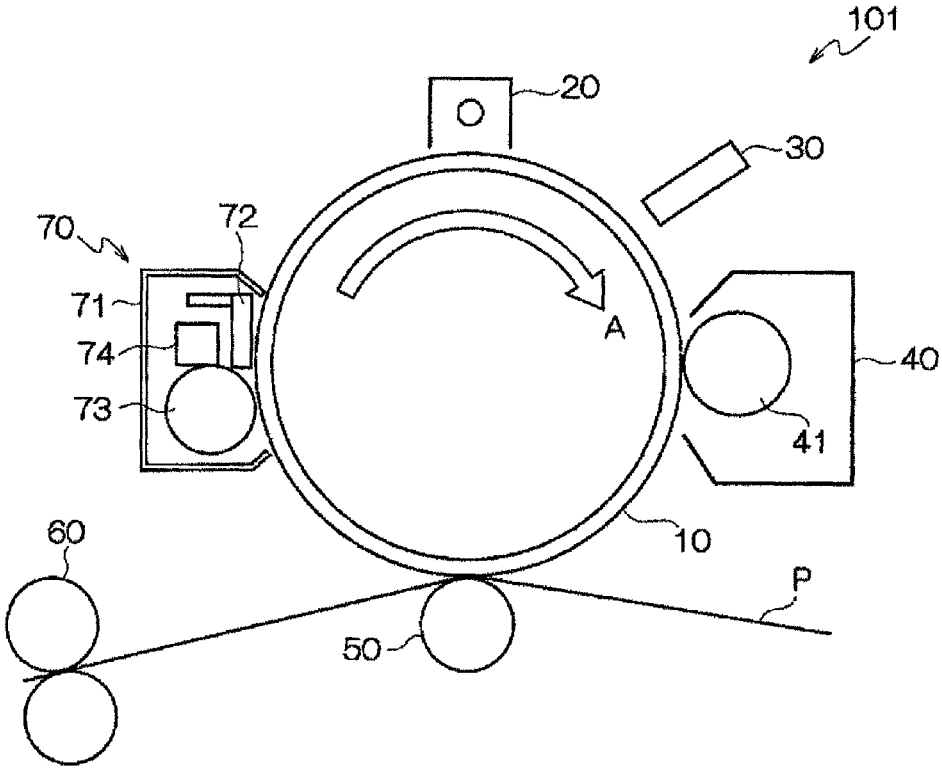
FIG. 4 is a diagram schematically showing the configuration of an image forming apparatus according to an exemplary embodiment.

FIG. 4 is a diagram schematically showing the configuration of an image forming apparatus according to this exemplary embodiment.

As shown in FIG. 4, an image forming apparatus 101 according to this exemplary embodiment is provided with, for example, an electrophotographic photoreceptor 10 that rotates in a clockwise direction as shown by the arrow A, a charging device 20 (an example of charging unit) that is provided above the electrophotographic photoreceptor 10 to face the electrophotographic photoreceptor 10 and to charge a surface of the electrophotographic photoreceptor 10, an exposure device 30 (an example of electrostatic latent image forming unit) that exposes the surface of the electrophotographic photoreceptor 10 charged by the charging device 20 to form an electrostatic latent image, a developing device 40 (an example of developing unit) that adheres a toner contained in a developer to the electrostatic latent image formed using the exposure device 30 to form a toner image on the surface of the electrophotographic photoreceptor 10, a transfer device 50 that causes recording paper P (transfer medium) to be charged with a polarity different from the charging polarity of the toner to transfer the toner image on the electrophotographic photoreceptor 10 onto the recording paper P, and a cleaning device 70 (an example of toner removing unit) that cleans the surface of the electrophotographic photoreceptor 10. In addition, a fixing device 60 is provided to fix the toner image while transporting the recording paper P with the toner image formed thereon.

Hereinafter, the major constituent members in the image forming apparatus 101 according to this exemplary embodiment will be described in detail.

Charging Device

Examples of the charging device 20 include contact-type charging units using a conductive charging roller, a charging brush, a charging film, a charging rubber blade, a charging tube, and the like. In addition, examples of the charging device 20 also include well-known charging units such as non-contact-type roller charging units, and scorotron charging units and corotron charging units using corona discharge. A contact-type charging unit is preferable as the charging device 20.

Exposure Device

Examples of the exposure device 30 include optical equipment that exposes the surface of the electrophotographic photoreceptor 10 with light such as semiconductor laser light, LED light, or liquid crystal shutter light in the form of an image. The wavelength of a light source is preferably in the spectral sensitivity region of the electrophotographic photoreceptor 10. As for the wavelength of the semiconductor laser, for example, a near-infrared laser having an oscillation wavelength of approximately 780 nm may be preferably used. However, the wavelength is not limited thereto, and a laser having an oscillation wavelength of 600 nm to less than 700 nm or a laser having an oscillation wavelength of 400 nm to 450 nm as a blue laser may also be used. In addition, as the exposure device 30, it is also effective to use a surface-emitting laser light source that outputs multi-beams in order to form a color image for example.

Developing Device

Examples of the configuration of the developing device 40 include a configuration in which a developing roll 41 arranged in a developing region so as to be opposed to the electrophotographic photoreceptor 10 is provided in a container accommodating a two-component developer formed of a toner and a carrier. The developing device 40 is not particularly limited as long as it performs the development with a two-component developer, and a known configuration is employed.

Here, the developer for use in the developing device 40 will be described.

The developer may be a single-component developer formed of a toner, or may be a two-component developer containing a toner and a carrier.

The toner contains, for example, toner particles containing a binder resin, a colorant, and if necessary, other additives such as a release agent, and if necessary, an external additive.

The average shape factor of the toner particles (a number average of the shape factor represented by the expression: shape factor=$(ML^2/A)\times(\pi/4)\times100$, where ML represents a maximum length of the particle and A represents a projected area of the particle) is preferably from 100 to 150, more preferably from 105 to 145, and even more preferably from 110 to 140. Furthermore, a volume average particle diameter of the toner is preferably from 3 μm to 12 more preferably from 3.5 μm to 10 μm, and even more preferably from 4 μm to 9 μm.

Although the method of manufacturing the toner particles is not particularly limited, toner particles are used that are manufactured by, for example, a kneading and pulverizing method in which a binder resin, a colorant, a release agent, and if necessary, a charge-controlling agent and the like are added, and the resultant mixture is kneaded, pulverized and classified; a method in which the shapes of the particles obtained using the kneading and pulverizing method are changed by a mechanical impact force or thermal energy; an emulsion polymerization and aggregation method in which polymerizable monomers of a binder resin are subjected to emulsion polymerization, the resultant dispersion formed and a dispersion of a colorant, a release agent, and if necessary, a charge-controlling agent and the like are mixed, aggregated, and heat-melt to obtain toner particles; a suspension polymerization method in which polymerizable monomers for obtaining a binder resin, a colorant, a release agent, and if necessary, a solution of a charge-controlling agent are suspended in an aqueous solvent and polymerization is performed; and a dissolution suspension method in which a binder resin, a colorant, a release agent, and if necessary, a solution of a charge-controlling agent are suspended in an aqueous solvent and granulation is performed.

In addition, a known method such as a manufacturing method in which the toner particles obtained using one of the above methods are used as a core to achieve a core shell structure by further making aggregated particles adhere to the toner particles and by coalescing them with heating is used. As the toner manufacturing method, a suspension polymerization method, an emulsion polymerization and aggregation method, and a dissolution suspension method, all of which are used to manufacture the toner particles using an aqueous solvent, are preferable, and an emulsion polymerization and aggregation method is particularly preferable from the viewpoint of controlling the shape and the particle size distribution.

The toner is manufactured by mixing the above toner particles and the above external additive using a Henschel mixer, a V-blender, or the like. In addition, when the toner particles are manufactured in a wet manner, the external additive may be externally added in a wet manner.

In addition, when the toner is used as a two-component developer, the mixing ratio of the toner to the carrier is set to a known ratio. The carrier is not particularly limited. However, preferable examples of the carrier include a carrier in which the surfaces of magnetic particles are coated with a resin.

Transfer Device

Examples of the transfer device 50 include well-known transfer charging units such as contact-type transfer charging units using a belt, a roller, a film, and a rubber blade, and scorotron transfer charging units and corotron transfer charging units using corona discharge.

Cleaning Device

The cleaning device 70 includes, for example, a housing 71, a cleaning blade 72, and a cleaning brush 73 arranged at the downstream side of the cleaning blade 72 in the rotation direction of the electrophotographic photoreceptor 10. In addition, for example, a lubricant 74 in a solid state is arranged to contact with the cleaning brush 73.

Hereinafter, the operation of the image forming apparatus 101 according to this exemplary embodiment will be described. First, when the electrophotographic photoreceptor 10 is rotated in the direction represented by the arrow A, it is negatively charged by the charging device 20 at the same time.

The electrophotographic photoreceptor 10, the surface of which has been negatively charged by the charging device 20, is exposed using the exposure device 30, and a latent image is formed on the surface thereof.

When a part in the electrophotographic photoreceptor 10, in which the latent image has been formed, approaches the developing device 40, the developing device 40 (developing roll 41) adheres a toner to the latent image to form a toner image.

When the electrophotographic photoreceptor 10 having the toner image formed thereon is further rotated in the direction of the arrow A, the transfer device 50 transfers the toner image onto recording paper P. As a result, the toner image is formed on the recording paper P.

The fixing device 60 fixes the toner image to the recording paper P having the image formed thereon.

Figure 5:
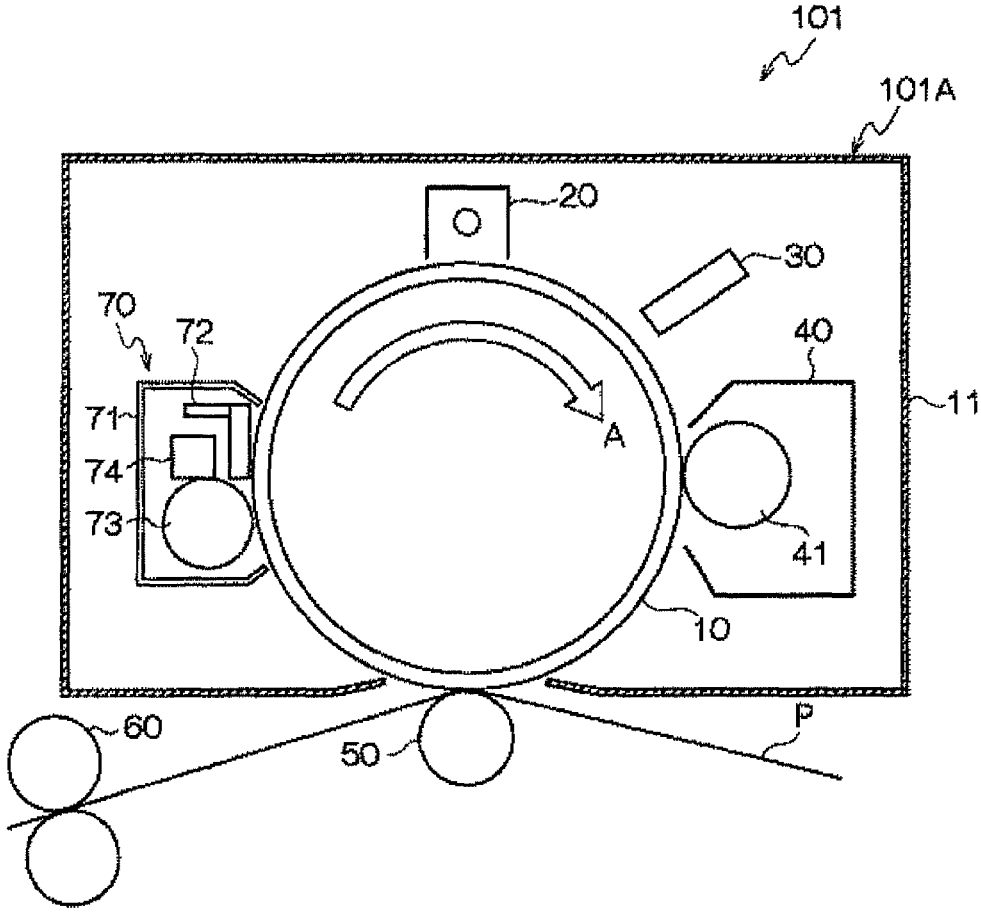
FIG. 5 is a diagram schematically showing the configuration of an image forming apparatus according to another exemplary embodiment.

The image forming apparatus 101 according to this exemplary embodiment may be provided with, for example, a process cartridge 101A that integrally accommodates an electrophotographic photoreceptor 10, a charging device 20, an exposure device 30, a developing device 40, and a cleaning device 70 in a housing 11 as shown in FIG. 5. This process cartridge 101A integrally accommodates plural members and is detachably mounted on the image forming apparatus 101.

The configuration of the process cartridge 101A is not limited thereto. Any configuration is applicable as long as the process cartridge 101A is provided with at least the electrophotographic photoreceptor 10. For example, a configuration may be also applicable in which the process cartridge 101A is provided with at least one selected from the charging device 20, the exposure device 30, the developing device 40, the transfer device 50, and the cleaning device 70.

The image forming apparatus 101 according to this exemplary embodiment is not limited to the above configuration. For example, the image forming apparatus 101 may be provided with a first erasing device, which aligns the polarities of the residual toners to easily remove the residual toners with the cleaning brush, and which is disposed around the electrophotographic photoreceptor 10 at the downstream side of the transfer device 50 in the rotation direction of the electrophotographic photoreceptor 10 and at the upstream side of the cleaning device 70 in the rotation direction of the electrophotographic photoreceptor. The image forming apparatus 101 may also be provided with a second erasing device, which erases charges on the surface of the electrophotographic photoreceptor 10, and which is disposed at the downstream side of the cleaning device 70 in the rotation direction of the electrophotographic photoreceptor and at the upstream side of the charging device 20 in the rotation direction of the electrophotographic photoreceptor.

In addition, the image forming apparatus 101 according to this exemplary embodiment is not limited to the above configuration. For example, a known configuration may be employed such as an intermediate transfer-type image forming apparatus in which a toner image formed on the electrophotographic photoreceptor 10 is transferred onto an intermediate transfer member and is then transferred onto recording paper P or a tandem-type image forming apparatus.

EXAMPLES

Hereinafter, the invention will be described in more detail on the basis of Examples and Comparative Examples. However, the invention is not limited at all to the following Examples.

Example 1

Formation of Undercoat layer 100 parts by weight of zinc oxide (average particle diameter: 70 nm, manufactured by Tayca Corporation, specific surface area value: 15 $m^2/g$) is mixed and stirred with 500 parts by weight of tetrahydrofuran, and 1.25 parts by weight of KBM603 (manufactured by Shin-Etsu Chemical Co., Ltd.) as a silane coupling agent is added thereto and the resultant is stirred for 2 hours. Thereafter, the tetrahydrofuran is distilled away by distillation under reduced pressure and baking is performed at 120° C. for 3 hours to obtain zinc oxide particles surface-treated with the silane coupling agent.

Next, 38 parts by weight of a solution obtained by dissolving 60 parts by weight of the surface-treated zinc oxide particles, 0.6 parts by weight of alizarin, 13.5 parts by weight of blocked isocyanate as a curing agent (SUMIDUR 3173, manufactured by Sumitomo Bayer Urethane Co., Ltd.), and 15 parts by weight of a butyral resin (S-LEC BM-1, manufactured by Sekisui Chemical Co., Ltd.) in 85 parts by weight of methyl ethyl ketone is mixed with 25 parts by weight of methyl ethyl ketone. The mixture is dispersed for 4 hours with a sand mill using glass beads having a diameter of 1 mm to obtain a dispersion.

Next, to the obtained dispersion, 0.005 parts by weight of dioctyltin dilaurate as a catalyst and 4.0 parts by weight of silicone resin particles (TOSPEARL 145, manufactured by GE Toshiba Silicones Co., Ltd.) are added to obtain a coating liquid for undercoat layer formation. Using a dipping coating method, an aluminum substrate having a diameter of 30 mm is coated with the coating liquid, and drying is performed for curing for 40 minutes at 180° C. to form an undercoat layer having a thickness of 25 μm.

Formation of Charge Generation Layer

Next, a mixture of 15 parts by weight of a chlorogallium phthalocyanine crystal as a charge generation material having strong diffraction peaks at least at Bragg angles)(2θ±0.2°) of 7.4°, 16.6°, 25.5°, and 28.3° with respect to CuKα characteristic X-ray, 10 parts by weight of a vinyl chloride-vinyl acetate copolymer resin (VMCH, manufactured by Nippon Union Carbide Corporation), and 300 parts by weight of n-butyl alcohol is dispersed for 4 hours with a sand mill using glass beads having a diameter of 1 mm to obtain a coating liquid for charge generation layer formation. The undercoat layer is dipped in and coated with the coating liquid for charge generation layer formation, and the coating liquid is dried for 5 minutes at 120° C. to form a charge generation layer having a thickness of 0.2 μm.

Formation of Charge Transport Layer

Next, 20 parts by weight of N,N'-bis(3-methylphenyl)-N,N'-diphenylbenzidine as a charge transport substance, 30 parts by weight of a bisphenol Z polycarbonate resin (viscosity average molecular weight: 40,000), and 0.5 part by weight of 2,6-di-t-butyl-4-methylphenol as an antioxidant are mixed with and dissolved in 120 parts by weight of tetrahydrofuran and 55 parts by weight of toluene to obtain a coating liquid for charge transport layer formation.

The charge generation layer is dipped in and coated with the coating liquid for charge transport layer formation, and the coating liquid is dried for 40 minutes at 120° C. to form a charge transport layer having a thickness of 22 μm.

Formation of Surface Protective Layer

Next, 10 parts by weight of tetrafluoroethylene resin particles as fluorine resin particles ("Lubron L-2" manufactured by Daikin Industries, Ltd.) and 0.3 parts by weight of a fluorinated alkyl group-containing copolymer having a repeating unit represented by the following Structural Formula (2) (weight average molecular weight: 50,000, l:m=1:1, s=1, n=60) are sufficiently mixed and stirred with 40 parts by weight of cyclopentanone to prepare a tetrafluoroethylene resin particle suspension.

Next, 45 parts by weight of the exemplary compound (I-15) as a first reactive charge transport material, 15 parts by weight of the exemplary compound (I-26) as a second reactive charge transport material, 4 parts by weight of the exemplary compound (A)-17 as a guanamine compound (benzoguanamine compound "NIKALAC BL-60", manufactured by Sanwa Chemical Co., Ltd.), and 1.5 parts by weight of bis(4-diethylamino-2-methylphenyl)-(4-diethylaminophenyl)-methane as an antioxidant are added to 220 parts by weight of cyclopentanone, and sufficiently mixed and dissolved. Furthermore, the tetrafluoroethylene resin particle suspension is added thereto and mixed and stirred.

Next, a dispersing process of the obtained mixture is repeatedly performed 20 times under pressure increased to 700 $kgf/cm^2$ using a high-pressure homogenizer on which a penetration-type chamber having a minute channel is mounted (manufactured by Yoshida Kikai Co., Ltd., YSNM-1500AR). Then, 1 part by weight of dimethylpolysiloxane (Glanol 450, manufactured by Kyoeisha Chemical Co., Ltd.), and 0.1 parts by weight of NACURE 5225 as a curing catalyst (manufactured by King Industries, Inc.) are added to prepare a coating liquid for surface protective layer formation.

Using a dipping coating method, the charge transport layer is coated with the coating liquid for surface protective layer formation, and the coating liquid is dried for 35 minutes at 155° C. to form a surface protective layer having a thickness of about 8 μm.

Structural Formula 2

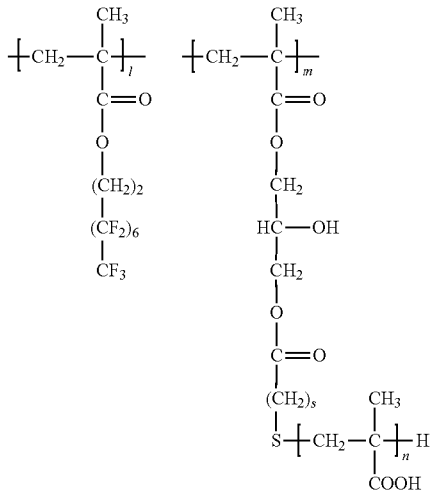

Through the above processes, an electrophotographic photoreceptor is obtained. The obtained electrophotographic photoreceptor is set as a photoreceptor 1.

Examples 2 to 16, Comparative Examples 1 to 7

Electrophotographic photoreceptors are obtained in the same manner as in Example 1, except that the composition of the surface protective layer is changed in accordance with Tables 1 to 3. These are set as photoreceptors 2 to 16 and comparative photoreceptors 1 to 7.

However, in the cases of the photoreceptors 14 to 16, in the composition of the charge transport layer, the number of parts by weight of N,N'-bis(3-methylphenyl)-N,N'-diphenylbenzidine (referred to as "benzidine") and the number of parts by weight of a bisphenol Z polycarbonate resin (referred to as "polycarbonate resin") are changed as follows.

Photoreceptor 14: 15 parts by weight of benzidine and 35 parts by weight of a polycarbonate resin Photoreceptor 15: 25 parts by weight of benzidine and 25 parts by weight of a polycarbonate resin Photoreceptor 16: 35 parts by weight of benzidine and 15 parts by weight of a polycarbonate resin Evaluation As for the photoreceptors obtained in the respective Examples, characteristics of the surface protective layer are examined, and abrasion of the surface protective layer, abrasion of the cleaning blade, unevenness in image density, and fogging are evaluated. The results thereof are shown in Tables 4 and 5.

Characteristics of Surface Protective Layer

As characteristics of the surface protective layer, an elastic deformation ratio R, a Young's modulus when the surface protective layer is laminated, and a Young's modulus when the surface protective layer is peeled off are examined in accordance with the above-described methods.

Evaluation of Abrasion of Surface Protective Layer

A difference between an image part and a non-image part in the abrasion amount of the surface protective layer is evaluated as follows.

An electrophotographic photoreceptor as an evaluation target is mounted on Color 1000 Press (manufactured by Fuji Xerox Co., Ltd.), and subsequently, under conditions of 20° C. and 50% RH, an image having an average image density of 5% in which an image part having an image density of 100% and a non-image part having an image density of 0% are present is printed on 100,000 sheets of A4 paper. At this time, the abrasion amount in the image part per 1,000 rotations of the drum is represented by WD1, and the abrasion amount in the non-image part per 1,000 rotations of the drum is represented by WD2.

In the method of evaluating the abrasion amount, the thickness of the surface protective layer is measured before and after printing, and a difference therebetween is set as an abrasion amount. In the thickness measurement, an optical interference-type film thickness gauge (FE-3000, manufactured by Otsuka Electronics Co., Ltd.) is used, and measurement is performed at 10 points on the electrophotographic photoreceptor. The average value thereof is set as a thickness.

The evaluation standards are as follows.

A: $|WD1-WD2| \leq 0.2$ nm

B: 0.2 nm$<|WD1-WD2| \leq 0.5$ nm

C: 0.5 nm$<|WD1-WD2| \leq 1.2$ nm

D: 1.2 nm$<|WD1-WD2|$

Evaluation of Abrasion of Cleaning Blade

A difference between an image part and a non-image part in the abrasion amount of the cleaning blade is evaluated as follows.

An electrophotographic photoreceptor as an evaluation target is mounted on Color 1000 Press (manufactured by Fuji Xerox Co., Ltd.), and subsequently, under conditions of 20° C. and 50% RH, an image having an average image density of 5% in which an image part having an image density of 100% and a non-image part having an image density of 0% are present is printed on 100,000 sheets of A4 paper. At this time, the abrasion amount in the image part per 1,000 rotations of the drum is represented by WC1, and the abrasion amount in the non-image part per 1,000 rotations of the drum is represented by WC2.

Figure 6:
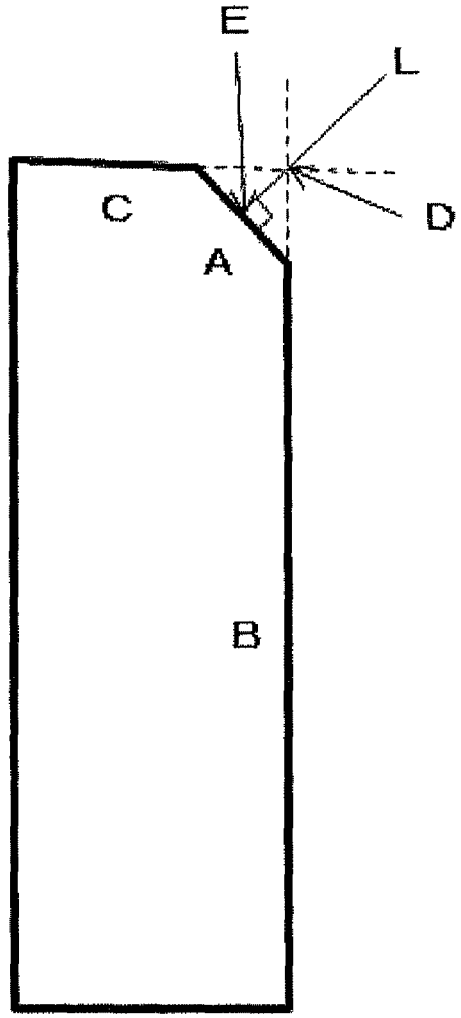
FIG. 6 is a schematic diagram illustrating the abrasion amount of a cleaning blade in Examples.

In the method of evaluating the abrasion amount of the cleaning blade, a cross-section of the cleaning blade is observed after printing, and as shown in FIG. 6, a surface A of the cleaning blade brought into contact with the photoreceptor is defined. Next, a straight line L perpendicular to the surface A is drawn to pass through an intersection D of extensions of a long side B and a short side C of the cross-section of the cleaning blade, and an intersection of the straight line L and the surface A is set as an intersection E. At this time, the distance between the intersection D and the intersection E is set as an abrasion amount of the cleaning blade.

The evaluation standards are as follows.

A: $|WC1-WC2| \leq 0.2$ μm

B: 0.2 μm$<|WC1-WC2| \leq 1.0$ μm

C: 1.0 μm$<|WC1-WC2| \leq 5.0$ μm

D: 5.0 μm$<|WC1-WC2|$

Evaluation of Unevenness in Image Density

Unevenness in image density that is caused by a difference in the abrasion amount of the surface protective layer or a difference in the abrasion amount of the cleaning blade is evaluated as follows.

An electrophotographic photoreceptor as an evaluation target is mounted on Color 1000 Press (manufactured by Fuji Xerox Co., Ltd.), and subsequently, under conditions of 20° C. and 50% RH, an image having an average image density of 5% in which an image part having an image density of 100% and a non-image part having an image density of 0% are present is printed on 100,000 sheets of A4 paper. Next, a full half-tone image having an image density of 30% is collected and viewed with a naked eye to evaluate unevenness in density of the half-tone image in the image part and the non-image part.

The evaluation standards are as follows.

A: No unevenness

B: Extremely slight unevenness has occurred

C: Slight unevenness has occurred

D: Unevenness has occurred

Evaluation of Fogging

Fogging that is caused by a difference in the abrasion amount of the surface protective layer or a difference in the abrasion amount of the cleaning blade is evaluated as follows.

An electrophotographic photoreceptor as an evaluation target is mounted on Color 1000 Press (manufactured by Fuji Xerox Co., Ltd.), and subsequently, under conditions of 20° C. and 50% RH, an image having an average image density of 5% in which an image part having an image density of 100% and a non-image part having an image density of 0% are present is printed on 100,000 sheets of A4 paper. Next, a blank paper image having an image density of 0% is collected and viewed with a naked eye to evaluate fogging of the blank paper image in the image part and the non-image part.

The evaluation standards are as follows.

A: No fogging

B: Extremely slight fogging has occurred

C: Slight fogging has occurred

D: Fogging has occurred

TABLE 1

| | Composition of Surface Protective Layer (Composition of Coating Liquid for Surface Protective Layer Formation) | | | | | | | |
|---|---|---|---|---|---|---|---|---|
| | First Reactive Charge Transport Material | | Second Reactive Charge Transport Material | | Guanamine Compound or Melamine Compound | | Fluorine Resin Particles | |
| Photoreceptor | Kind | Amount (Parts) | Kind | Amount (Parts) | Kind | Amount (Parts) | Kind | Amount (Parts) |
| Photoreceptor 1 | I-15 | 45 | I-26 | 15 | (A)-17 | 4 | Lubron L-2 | 10 |
| Photoreceptor 2 | I-15 | 45 | I-27 | 15 | (A)-17 | 4 | Lubron L-2 | 10 |
| Photoreceptor 3 | I-15 | 45 | I-33 | 15 | (A)-17 | 4 | Lubron L-2 | 10 |
| Photoreceptor 4 | I-21 | 45 | I-26 | 15 | (A)-17 | 4 | Lubron L-2 | 10 |
| Photoreceptor 5 | I-21 | 45 | I-27 | 15 | (A)-17 | 4 | Lubron L-2 | 10 |
| Photoreceptor 6 | I-21 | 45 | I-33 | 15 | (A)-17 | 4 | Lubron L-2 | 10 |
| Photoreceptor 7 | I-15 | 45 | I-26 | 20 | (A)-17 | 4 | Lubron L-2 | 10 |
| Photoreceptor 8 | I-15 | 45 | I-26 | 9 | (A)-17 | 4 | Lubron L-2 | 10 |
| Photoreceptor 9 | I-15 | 45 | I-26 | 4.5 | (A)-17 | 4 | Lubron L-2 | 10 |
| Photoreceptor 10 | I-15 | 45 | I-26 | 3 | (A)-17 | 4 | Lubron L-2 | 10 |

| | Composition of Surface Protective Layer (Composition of Coating Liquid for Surface Protective Layer Formation) | | | | | |
|---|---|---|---|---|---|---|
| | Fluorinated Alkyl Group-Containing Copolymer | | Antioxidant | | Curing Catalyst | |
| Photoreceptor | Kind | Amount (Parts) | Kind | Amount (Parts) | Kind | Amount (Parts) |
| Photoreceptor 1 | Structural Formula 2 l:m = 1:1 | 0.3 | Tris-TPM | 1.5 | NACURE 5225 | 0.1 |
| Photoreceptor 2 | Structural Formula 2 l:m = 1:1 | 0.3 | Tris-TPM | 1.5 | NACURE 5225 | 0.1 |
| Photoreceptor 3 | Structural Formula 2 l:m = 1:1 | 0.3 | Tris-TPM | 1.5 | NACURE 5225 | 0.1 |
| Photoreceptor 4 | Structural Formula 2 l:m = 1:1 | 0.3 | Tris-TPM | 1.5 | NACURE 5225 | 0.1 |
| Photoreceptor 5 | Structural Formula 2 l:m = 1:1 | 0.3 | Tris-TPM | 1.5 | NACURE 5225 | 0.1 |
| Photoreceptor 6 | Structural Formula 2 l:m = 1:1 | 0.3 | Tris-TPM | 1.5 | NACURE 5225 | 0.1 |
| Photoreceptor 7 | Structural Formula 2 l:m = 1:1 | 0.3 | Tris-TPM | 1.5 | NACURE 5225 | 0.1 |
| Photoreceptor 8 | Structural Formula 2 l:m = 1:1 | 0.3 | Tris-TPM | 1.5 | NACURE 5225 | 0.1 |
| Photoreceptor 9 | Structural Formula 2 l:m = 1:1 | 0.3 | Tris-TPM | 1.5 | NACURE 5225 | 0.1 |
| Photoreceptor 10 | Structural Formula 2 l:m = 1:1 | 0.3 | Tris-TPM | 1.5 | NACURE 5225 | 0.1 |

TABLE 2

| | Composition of Surface Protective Layer (Composition of Coating Liquid for Surface Protective Layer Formation) | | | | | | | |
|---|---|---|---|---|---|---|---|---|
| | First Reactive Charge Transport Material | | Second Reactive Charge Transport Material | | Guanamine Compound or Melamine Compound | | Fluorine Resin Particles | |
| Photoreceptor | Kind | Amount (Parts) | Kind | Amount (Parts) | Kind | Amount (Parts) | Kind | Amount (Parts) |
| Photoreceptor 11 | I-15 | 45 | I-26 | 2.3 | (A)-17 | 4 | Lubron L-2 | 10 |
| Photoreceptor 12 | I-15 | 45 | I-26 | 15 | (A)-17 | 4 | Lubron L-2 | 10 |
| Photoreceptor 13 | I-15 | 45 | I-26 | 15 | (A)-17 | 4 | Lubron L-2 | 10 |

TABLE 2-continued

| | | | | | | | | |
|---|---|---|---|---|---|---|---|---|
| Photoreceptor 14 | I-15 | 45 | I-26 | 15 | (A)-17 | 4 | Lubron L-2 | 10 |
| Photoreceptor 15 | I-15 | 45 | I-26 | 15 | (A)-17 | 4 | Lubron L-2 | 10 |
| Photoreceptor 16 | I-15 | 45 | I-26 | 15 | (A)-17 | 4 | Lubron L-2 | 10 |

| | Composition of Surface Protective Layer (Composition of Coating Liquid for Surface Protective Layer Formation) | | | | | |
|---|---|---|---|---|---|---|
| | Fluorinated Alkyl Group-Containing Copolymer | | Antioxidant | | Curing Catalyst | |
| Photoreceptor | Kind | Amount (Parts) | Kind | Amount (Parts) | Kind | Amount (Parts) |
| Photoreceptor 11 | Structural Formula 2 l:m = 1:1 | 0.3 | Tris-TPM | 1.5 | NACURE 5225 | 0.1 |
| Photoreceptor 12 | Structural Formula 2 l:m = 1:2 | 0.3 | Tris-TPM | 1.5 | NACURE 5225 | 0.2 |
| Photoreceptor 13 | Structural Formula 2 l:m = 1:3 | 0.3 | Tris-TPM | 1.5 | NACURE 5225 | 0.3 |
| Photoreceptor 14 | Structural Formula 2 l:m = 2:1 | 0.3 | Tris-TPM | 1.5 | NACURE 5225 | 0.1 |
| Photoreceptor 15 | Structural Formula 2 l:m = 3:1 | 0.3 | Tris-TPM | 1.5 | NACURE 5225 | 0.2 |
| Photoreceptor 16 | Structural Formula 2 l:m = 3:1 | 0.3 | Tris-TPM | 1.5 | NACURE 5225 | 0.2 |

TABLE 3

| | Composition of Surface Protective Layer (Composition of Coating Liquid for Surface Protective Layer Formation | | | | | | | |
|---|---|---|---|---|---|---|---|---|
| | First Reactive Charge Transport Material | | Second Reactive Charge Transport Material | | Guanamine Compound or Melamine Compound | | Fluorine Resin Particles | |
| Photoreceptor | Kind | Amount (Parts) | Kind | Amount (Parts) | Kind | Amount (Parts) | Kind | Amount (Parts) |
| Comparative Photoreceptor 1 | I-8 | 45 | I-26 | 15 | (A)-17 | 4 | Lubron L-2 | 10 |
| Comparative Photoreceptor 2 | I-8 | 45 | I-27 | 15 | (A)-17 | 4 | Lubron L-2 | 10 |
| Comparative Photoreceptor 3 | I-8 | 45 | I-33 | 15 | (A)-17 | 4 | Lubron L-2 | 10 |
| Comparative Photoreceptor 4 | I-8 | 45 | I-26 | 30 | (A)-17 | 4 | Lubron L-2 | 10 |
| Comparative Photoreceptor 5 | I-8 | 45 | I-26 | 2 | (A)-17 | 4 | Lubron L-2 | 10 |
| Comparative Photoreceptor 6 | I-8 | 45 | I-26 | 15 | (A)-17 | 4 | Lubron L-2 | 10 |
| Comparative Photoreceptor 7 | I-8 | 45 | I-26 | 15 | (A)-17 | 4 | Lubron L-2 | 10 |

| | Composition of Surface Protective Layer (Composition of Coating Liquid for Surface Protective Layer Formation | | | | | |
|---|---|---|---|---|---|---|
| | Fluorinated Alkyl Group-Containing Copolymer | | Antioxidant | | Curing Catalyst | |
| Photoreceptor | Kind | Amount (Parts) | Kind | Amount (Parts) | Kind | Amount (Parts) |
| Comparative Photoreceptor 1 | Structural Formula 2 l:m = 1:1 | 0.3 | Tris-TPM | 2.0 | NACURE 5225 | 0.2 |
| Comparative Photoreceptor 2 | Structural Formula 2 l:m = 1:1 | 0.3 | Tris-TPM | 1.0 | NACURE 5225 | 0.2 |

TABLE 3-continued

| | | | | | | |
|---|---|---|---|---|---|---|
| Comparative Photoreceptor 3 | Structural Formula 2 l:m = 1:1 | 0.3 | Tris-TPM | 1.5 | NACURE 5225 | 0.2 |
| Comparative Photoreceptor 4 | Structural Formula 2 l:m = 1:1 | 0.3 | Tris-TPM | 1.5 | NACURE 5225 | 0.1 |
| Comparative Photoreceptor 5 | Structural Formula 2 l:m = 1:1 | 0.3 | Tris-TPM | 2.0 | NACURE 5225 | 0.1 |
| Comparative Photoreceptor 6 | Structural Formula 2 l:m = 1:1 | 0.3 | Tris-TPM | 1.0 | NACURE 5225 | 0.3 |
| Comparative Photoreceptor 7 | Structural Formula 2 l:m = 1:1 | 0.3 | Tris-TPM | 1.0 | NACURE 5225 | 0.5 |

TABLE 4

| | | Characteristics of Electrophotographic Photoreceptor | | | | Evaluation Results | | | |
|---|---|---|---|---|---|---|---|---|---|
| Example No. | Photoreceptor No. | Elastic Deformation Ratio R | Young's Modulus M1 When Surface Protective Layer is Laminated (GPa) | Young's Modulus M2 When Surface Protective Layer is Peeled Off (GPa) | M1/M2 | Evaluation of Abrasion of Surface Protective Layer of Photo-receptor | Evaluation of Abrasion of Cleaning Blade | Evaluation of Unevenness in Image Density | Evaluation of Fogging |
| Example 1 | Photoreceptor 1 | 0.490 | 4.0 | 4.3 | 0.9 | A | A | A | A |
| Example 2 | Photoreceptor 2 | 0.501 | 3.9 | 4.3 | 0.9 | A | B | A | A |
| Example 3 | Photoreceptor 3 | 0.488 | 4.3 | 4.3 | 1.0 | A | A | A | A |
| Example 4 | Photoreceptor 4 | 0.492 | 3.9 | 4.3 | 0.9 | A | A | A | A |
| Example 5 | Photoreceptor 5 | 0.505 | 3.8 | 4.3 | 0.9 | A | A | A | A |
| Example 6 | Photoreceptor 6 | 0.485 | 4.2 | 4.3 | 1.0 | A | A | A | A |
| Example 7 | Photoreceptor 7 | 0.505 | 3.8 | 4.3 | 0.9 | A | B | A | B |
| Example 8 | Photoreceptor 8 | 0.482 | 4.4 | 4.3 | 1.0 | A | A | A | A |
| Example 9 | Photoreceptor 9 | 0.458 | 4.5 | 4.3 | 1.0 | A | A | A | A |
| Example 10 | Photoreceptor 10 | 0.432 | 4.8 | 4.3 | 1.1 | B | B | B | B |
| Example 11 | Photoreceptor 11 | 0.401 | 4.9 | 4.3 | 1.1 | B | A | B | A |
| Example 12 | Photoreceptor 12 | 0.499 | 3.9 | 4.3 | 0.9 | A | B | A | B |
| Example 13 | Photoreceptor 13 | 0.502 | 3.8 | 4.3 | 0.9 | A | B | A | B |
| Example 14 | Photoreceptor 14 | 0.490 | 4.0 | 4.1 | 1.0 | A | A | A | A |
| Example 15 | Photoreceptor 15 | 0.490 | 4.0 | 4.5 | 0.9 | A | A | A | A |
| Example 16 | Photoreceptor 16 | 0.490 | 4.0 | 4.6 | 0.9 | A | A | A | A |

TABLE 5

| | | Characteristics of Electrophotographic Photoreceptor | | | | Evaluation Results | | | |
|---|---|---|---|---|---|---|---|---|---|
| Comparative Example No. | Photoreceptor No. | Elastic Deformation Ratio R | Young's Modulus M1 When Surface Protective Layer is Laminated (GPa) | Young's Modulus M2 When Surface Protective Layer is Peeled Off (GPa) | M1/M2 | Evaluation of Abrasion of Surface Protective Layer of Photo-receptor | Evaluation of Abrasion of Cleaning Blade | Evaluation of Uneven-ness in Image Density | Evalua-tion of Fogging |
| Comparative Example 1 | Comparative Photoreceptor 1 | 0.391 | 5.3 | 4.3 | 1.2 | D | B | D | D |
| Comparative Example 2 | Comparative Photoreceptor 2 | 0.39 | 5.7 | 4.3 | 1.3 | D | B | D | D |
| Comparative Example 3 | Comparative Photoreceptor 3 | 0.385 | 5.2 | 4.3 | 1.2 | D | B | D | D |
| Comparative Example 4 | Comparative Photoreceptor 4 | 0.525 | 3.6 | 4.3 | 0.8 | B | D | B | D |
| Comparative Example 5 | Comparative Photoreceptor 5 | 0.389 | 5.2 | 4.3 | 1.2 | D | B | D | D |
| Comparative Example 6 | Comparative Photoreceptor 6 | 0.395 | 4.9 | 4.3 | 1.1 | C | B | C | C |
| Comparative Example 7 | Comparative Photoreceptor 7 | 0.398 | 4.8 | 4.3 | 1.1 | C | B | C | C |

From the above results, it is found that in Examples, good results are obtained in the evaluations of abrasion of the surface protective layer, abrasion of the cleaning blade, unevenness in image density, and fogging in comparison to Comparative Examples.

Further details of Tables 1 to 3 are as follows.

Lubron L-2: tetrafluoroethylene resin particles ("Lubron L-2", manufactured by Daikin Industries, Ltd.)

NACURE 5225 (manufactured by King Industries, Inc.)

Tris-TPM: bis(4-diethylamino-2-methylphenyl)-(4-diethylaminophenyl)-methane

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a photosensitive layer that is provided on the conductive substrate; and a surface layer that is provided on the photosensitive layer, wherein the surface layer is formed of a cured film of a composition including a guanamine compound;

a first reactive charge transport material having a hydroxyl group and a second reactive charge transport material having methoxy groups; and a catalyst, wherein the cured film has an elastic deformation ratio R satisfying the following Expression (1):

$$0.40 \leq R \leq 0.51 \quad (1),$$

and a blending ratio of the catalyst is from 0.1% by weight to 50% by weight with respect to all of the solid contents of the surface layer excluding any fluorine resin particles present in the composition and any fluorinated alkyl group-containing copolymers present in the composition.

2. The electrophotographic photoreceptor according to claim 1, wherein a ratio of the first reactive charge transport material to the second reactive charge transport material is from 2 to 20 in terms of weight ratio.

3. The electrophotographic photoreceptor according to claim 1, wherein the photoreceptor satisfies the following Expression (2):

$$3.8 \leq M1 \leq 5 \quad (2)$$

wherein M1 represents a Young's modulus (GPa) of the surface layer when the surface layer is laminated.

4. The electrophotographic photoreceptor according to claim 1, wherein the photoreceptor satisfies the following Expression (3):

$$M1 \leq 1.1 \times M2 \quad (3)$$

wherein M1 represents a Young's modulus (GPa) of the surface layer when the surface layer is laminated, and M2 represents a Young's modulus (GPa) of the surface layer when the surface layer has been peeled off.

5. The electrophotographic photoreceptor according to claim 1, wherein the elastic deformation ratio R satisfies the following Expression (1-2):

$$0.43 \leq R \leq 0.50 \quad (1\text{-}2).$$

6. The electrophotographic photoreceptor according to claim 1, wherein the elastic deformation ratio R satisfies the following Expression (1-3):

$$0.45 \leq R \leq 0.50 \quad (1\text{-}3).$$

7. The electrophotographic photoreceptor according to claim 1, wherein the photoreceptor satisfies the following Expression (2-3):

$$4.0 \leq M1 \leq 4.5 \quad (2\text{-}3)$$

wherein M1 represents a Young's modulus (GPa) of the surface layer when the surface layer is laminated.

8. The electrophotographic photoreceptor according to claim 1, wherein the photoreceptor satisfies the following Expression (3-2):

$$0.9 \times M2 \leq M1 \leq M2 \quad (3\text{-}2)$$

wherein M1 represents a Young's modulus (GPa) of the surface layer when the surface layer is laminated, and M2 represents a Young's modulus (GPa) of the surface layer when the surface layer has been peeled off.

9. The electrophotographic photoreceptor according to claim 1, wherein the first reactive charge transport material has a plurality of hydroxyl groups.

10. The electrophotographic photoreceptor according to claim 1, wherein the photoreceptor further contains fluorine resin particles.

11. The electrophotographic photoreceptor according to claim 10, wherein an average primary particle diameter of the fluorine resin particles is from 0.05 μm to 2 μm.

12. The electrophotographic photoreceptor according to claim 10, wherein the fluorine resin is selected from polytetrafluoroethylene, a perfluoroalkoxy fluorine resin, polychlorotrifluoroethylene, polyvinylidene fluoride, polydichlorodifluoroethylene, tetrafluoroethylene-perfluoroalkylvinyl ether copolymers, tetrafluororoethylene-hexafluoropropylene copolymers, tetrafluoroethylene-ethylene copolymers, and tatrafluoroethylene-hexafluoropropylene-perfluoroalkylvinyl ether copolymers.

13. An image forming apparatus comprising:

an electrophotographic photoreceptor;

a charging unit that charges a surface of the electrophotographic photoreceptor;

a latent image forming unit that forms an electrostatic latent image on a charged surface of the electrophotographic photoreceptor;

a developing unit that develops the electrostatic latent image formed on the surface of the electrophotographic photoreceptor with a toner to form a toner image; and a transfer unit that transfers the toner image formed on the surface of the electrophotographic photoreceptor onto a recording medium, wherein the electrophotographic photoreceptor is the electrophotographic photoreceptor according to claim 1.

14. The image forming apparatus according to claim 13, wherein in the photoreceptor, a ratio of the first reactive charge transport material to the second reactive charge transport material is from 2 to 20 in terms of weight ratio.

15. A process cartridge comprising:

an electrophotographic photoreceptor; and a cleaning unit that cleans the electrophotographic photoreceptor, wherein the electrophotographic photoreceptor is the electrophotographic photoreceptor according to claim 1.

16. The process cartridge according to claim 15, wherein in the photoreceptor, a ratio of the first reactive charge transport material to the second reactive charge transport material is from 2 to 20 in terms of weight ratio.

17. The electrophotographic photoreceptor according to claim 1, wherein the blending ratio of the catalyst is from 10% by weight to 30% by weight with respect to all of the solid contents of the surface layer excluding the fluorine resin particles present in the composition and the fluorinated alkyl group-containing copolymers present in the composition.

* * * * *